US012000315B2

(12) United States Patent
Wing et al.

(10) Patent No.: US 12,000,315 B2
(45) Date of Patent: Jun. 4, 2024

(54) VARIABLE CAM TIMING PHASER AND SYSTEM INCLUDING THE SAME

(71) Applicant: BorgWarner Inc., Auburn Hills, MI (US)

(72) Inventors: Braman C. Wing, Ithaca, NY (US); Keith Feldt, Ithaca, NY (US); Adam Bruce, Ithaca, NY (US); Chris Thomas, Dryden, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 17/842,898

(22) Filed: Jun. 17, 2022

(65) Prior Publication Data

US 2023/0008355 A1 Jan. 12, 2023

Related U.S. Application Data

(60) Provisional application No. 63/220,079, filed on Jul. 9, 2021.

(51) Int. Cl.
*F01L 1/34* (2006.01)
*F01L 1/344* (2006.01)

(52) U.S. Cl.
CPC ... *F01L 1/3442* (2013.01); *F01L 2001/34426* (2013.01); *F01L 2001/34446* (2013.01); *F01L 2001/3445* (2013.01)

(58) Field of Classification Search
CPC ..... F01L 1/3442; F01L 2001/34426; F01L 2001/34446; F01L 2001/3443; F01L 2001/34433; F01L 2301/00; F01L 2001/34436; F01L 2303/00; F15D 1/02; F15D 1/04

(Continued)

(56) References Cited

U.S. PATENT DOCUMENTS 2,956,557 A * 10/1960 Dadd ..... F01L 1/245 123/90.55
6,748,912 B2 * 6/2004 Simpson ..... F01L 1/34409 74/568 R (Continued)

FOREIGN PATENT DOCUMENTS

EP 1762706 A2 * 3/2007 ..... F01L 1/3442

OTHER PUBLICATIONS

U.S. Appl. No. 63/177,191, filed Apr. 20, 2021.

*Primary Examiner* — Wesley G Harris

(74) *Attorney, Agent, or Firm* — Howard & Howard Attorneys PLLC

(57) ABSTRACT

A variable cam timing phaser of a variable cam timing system includes a housing and a rotor moveable with respect to the housing. The rotor and the housing define advance and retard chambers. The variable cam timing phaser also includes a control valve assembly. The control valve assembly includes a valve housing defining a valve housing interior, a supply port, first and second working ports, and an exhaust port. The control valve assembly also includes a piston moveable for controlling flow of the hydraulic fluid through the valve housing interior. The exhaust port is fluidly connectable with a sump through a vent path that is defined by at least one of the valve housing and the rotor. The vent path is configured to prevent air from being sucked into the variable cam timing phaser through the vent path.

11 Claims, 29 Drawing Sheets

(58) Field of Classification Search
USPC ..... 123/90.17, 90.15; 74/568 R
See application file for complete search history.

(56) References Cited

U.S. PATENT DOCUMENTS

| | | | | |
|---|---|---|---|---|
| 6,814,038 | B2 | 11/2004 | Smith | |
| 6,935,290 | B2 | 8/2005 | Jiang | |
| 6,941,913 | B2 | 9/2005 | Smith | |
| 7,841,310 | B2 | 11/2010 | Child | |
| 8,534,246 | B2 | 9/2013 | Lichti et al. | |
| 8,662,039 | B2 | 3/2014 | Fischer et al. | |
| 9,021,997 | B2 * | 5/2015 | Welte | F01L 1/3442 74/568 R |
| 9,115,652 | B2 * | 8/2015 | Choi | F02D 13/0253 |
| 9,127,575 | B2 | 9/2015 | Fischer et al. | |
| 10,001,036 | B2 | 6/2018 | Smith et al. | |
| 10,309,417 | B2 | 6/2019 | Harris et al. | |
| 10,316,859 | B2 | 6/2019 | Harris et al. | |
| 10,865,666 | B2 * | 12/2020 | Bruce | F01L 1/3442 |
| 2020/0141288 | A1 * | 5/2020 | Bruce | F01L 1/3442 |

* cited by examiner

VARIABLE CAM TIMING PHASER AND SYSTEM INCLUDING THE SAME

CROSS-REFERENCE TO RELATED APPLICATIONS

The present application claims priority to and all the benefits of U.S. Provisional Patent Application No. 63/220,079 filed Jul. 9, 2021, the disclosure of which is expressly hereby incorporated herein by reference in its entirety.

BACKGROUND OF THE INVENTION

1. Field of the Invention

The present invention generally relates to a variable cam timing phaser of a variable cam timing system.

2. Description of the Related Art

Conventional variable cam timing systems in the art include a camshaft and a variable cam timing phaser, with the variable cam timing phaser typically including a housing defining a housing interior, and a rotor disposed in the housing interior and moveable with respect to the housing. Typically, the rotor has a hub and a plurality of vanes extending from the hub, and the rotor and the housing define an advance chamber and a retard chamber. Conventional variable cam timing phasers also include a control valve assembly.

Conventional control valve assemblies known in the art include a valve housing defining a valve housing interior, a supply port for supplying hydraulic fluid to the valve housing interior, first and second working ports, and an exhaust port. The first working port is typically fluidly connectable with the advance chamber and the second working port is typically fluidly connectable with the retard chamber. Typically, the control valve assemblies known in the art also include a piston disposed in the valve housing interior and moveable within the valve housing interior for controlling flow of hydraulic fluid through the valve housing interior, which, in turn, controls the phase of the camshaft.

Commonly, the exhaust port of conventional control valve assemblies is fluidly connectable with a sump through a vent path. During operation of the variable cam timing phaser, the camshaft may be acted upon by forces imparted by intake and/or exhaust valves controlled by cams on the camshaft. Such forces, commonly referred to as "torsionals" or "torque reversals," may cause the camshaft to twist, which may cause slight oscillation during rotation of the camshaft, rather than the camshaft rotating smoothly. As a result of this, when the rotor of the variable cam timing phaser moves between an advance and retard position, the variable cam timing phaser is subject to torsional forces which may cause the vanes of the phaser to move back and forth within the advance and retard chambers, which may overcome the hydraulic fluid pressure which is attempting to move the vane and, in turn, the rotor in one direction or another.

When the rotor of the variable cam timing phaser moves toward the advance or retard position, and when the rotor experiences a "torque reversal" in the other of the advance or retard position, the vane rotating in the other of the advance or retard position typically causes a reduction in pressure in the advance or retard chamber. A reduction in pressure in the advance or retard chamber may cause air to be drawn back into the advance or retard chamber through the vent path, which results in a decreased performance due to excessive oscillation of the rotor.

As such, there remains a need to provide an improved control valve assembly of a variable cam timing phaser of a variable cam timing system.

SUMMARY OF THE INVENTION AND ADVANTAGES

A variable cam timing phaser of a variable cam timing system is provided. The variable cam timing system includes a camshaft. The variable cam timing phaser includes a housing having a housing wall disposed about an axis and defining a housing interior. The variable cam timing phaser also includes a rotor at least partially disposed within the housing interior and moveable with respect to the housing. The rotor has a hub and a plurality of vanes extending from the hub away from the axis toward the housing wall. The rotor and the housing define an advance chamber and a retard chamber. The variable cam timing phaser also includes a control valve assembly.

The control valve assembly includes a valve housing extending along an axis and defining a valve housing interior. The valve housing also defines a supply port for supplying hydraulic fluid to the valve housing interior, a first working port, a second working port, and an exhaust port. The first working port is fluidly connectable with one of the advance chamber and the retard chamber, and the second working port is fluidly connectable with the other of the advance chamber and the retard chamber. The control valve assembly also includes a piston disposed in the valve housing interior and moveable along the axis for controlling flow of the hydraulic fluid through the valve housing interior. The exhaust port is fluidly connectable with a sump through a vent path that is defined by at least one of the valve housing and the rotor. The vent path is configured to prevent air from being sucked into the variable cam timing phaser through the vent path.

Accordingly, the control valve assembly having a vent path defined by at least one of the valve housing and the rotor that is configured to prevent air from being sucked into the cam timing phaser through the vent path prevents air ingestion into the variable cam timing phaser and thus reduces oscillation of the rotor when rotating between the advance and retard positions.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
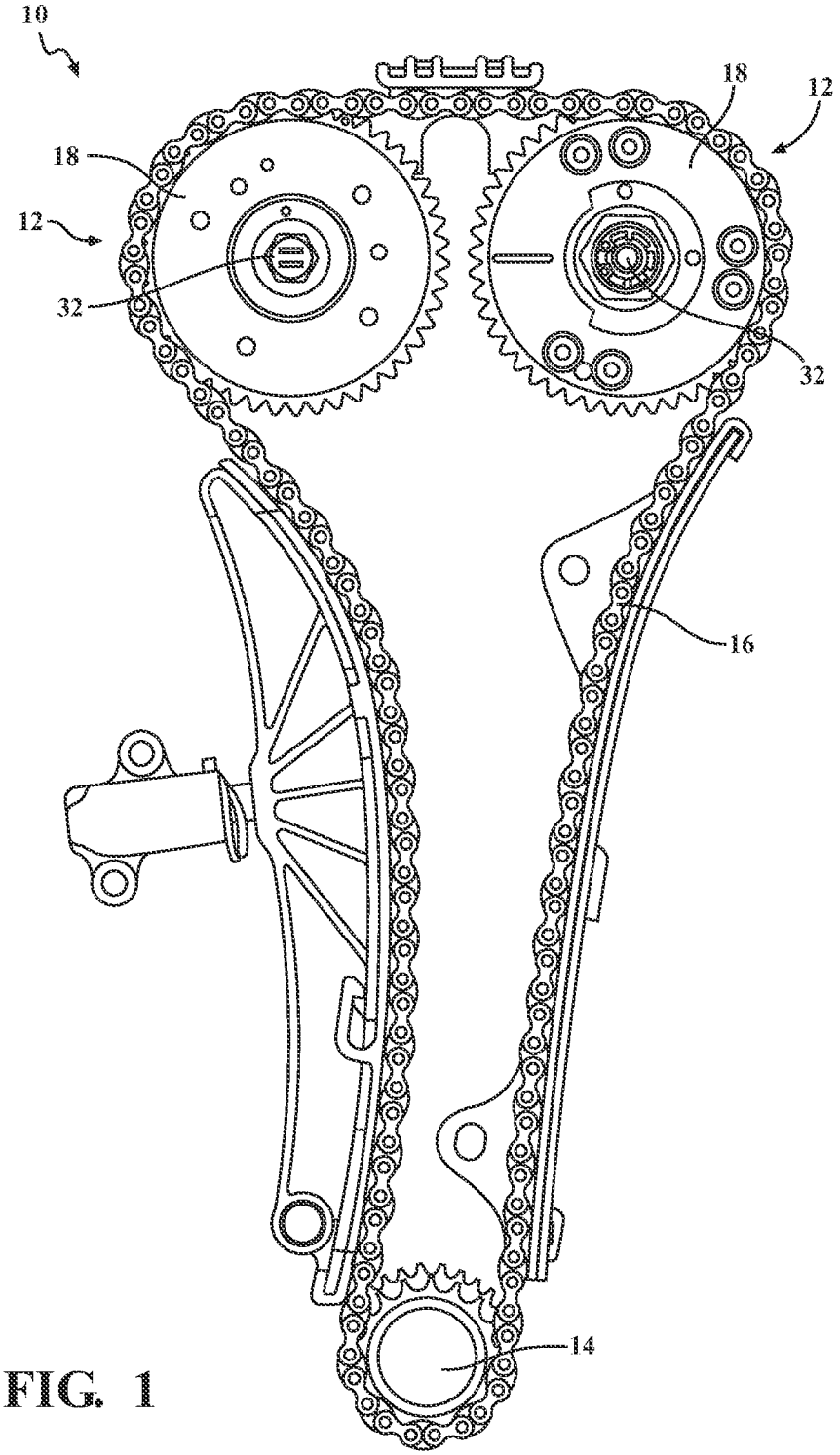
FIG. 1 is schematic illustration of the variable cam timing system including a crankshaft, a camshaft, a timing chain rotationally coupling the crankshaft and the camshaft, and a variable cam timing phaser rotationally coupling the camshaft and the timing chain.
Figure 2:
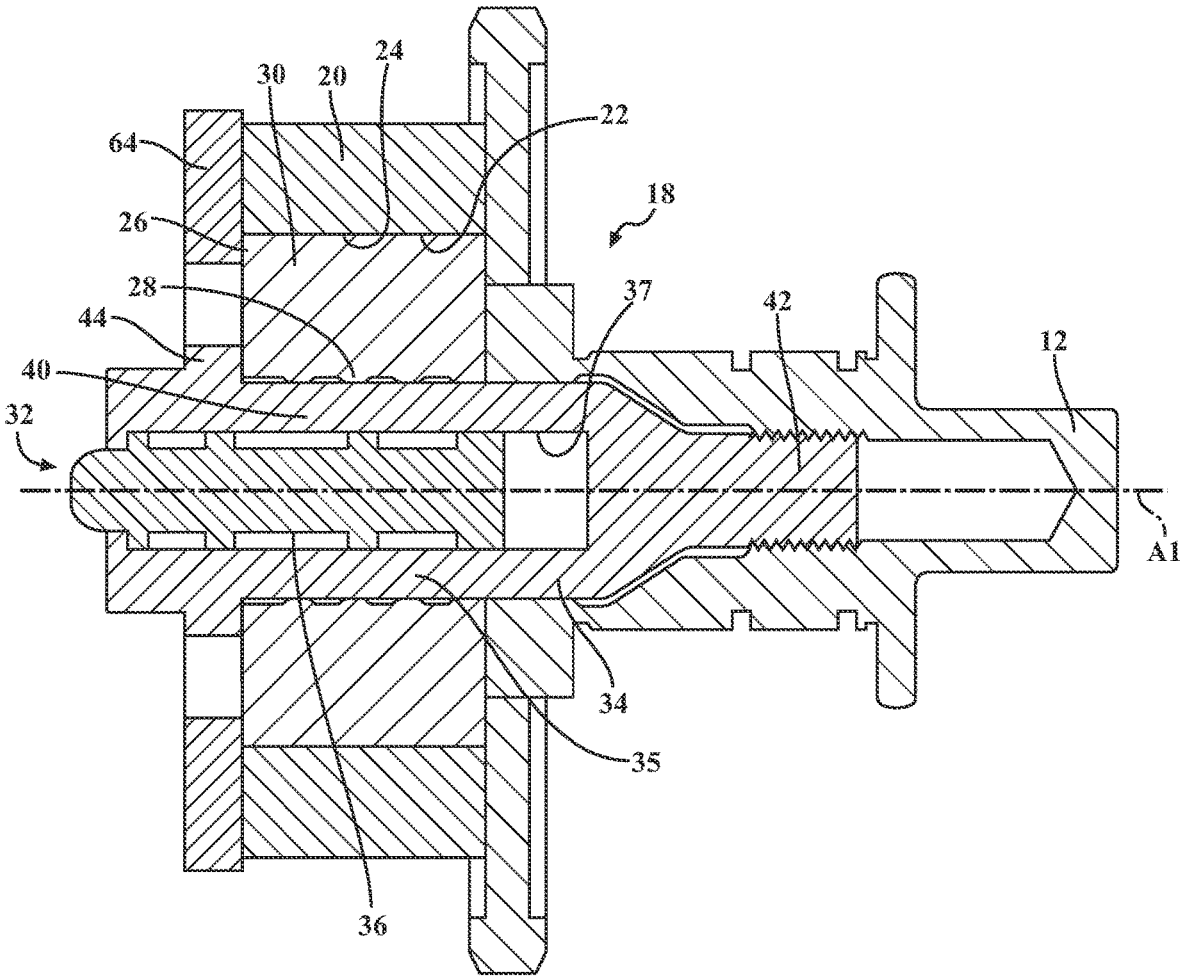
FIG. 2 is cross-sectional view of the variable cam timing phaser having a housing, a rotor, and a control valve assembly.
Figure 3:
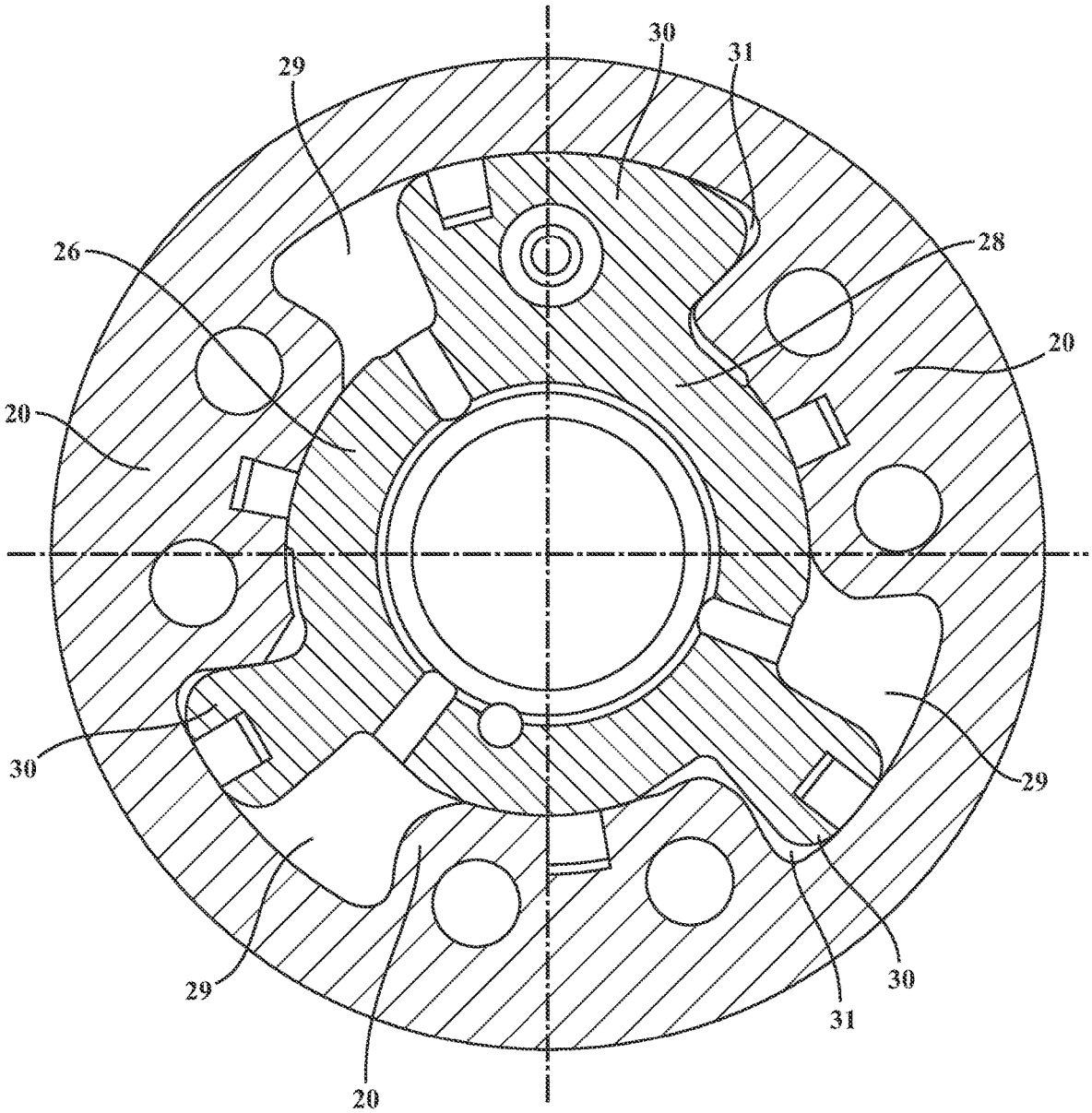
FIG. 3 is a frontal view of the variable cam timing phaser, with the rotor and the housing define an advance chamber and a retard chamber.

With reference to the Figures, wherein like numerals indicate like parts throughout the several views, a variable cam timing system 10 is shown in FIG. 1. The variable cam timing system 10 may be for an internal combustion engine. The variable cam timing system 10 may include a camshaft 12, a crankshaft 14, and a timing chain 16 rotationally coupling the camshaft 12 and the crankshaft 14. It is to be appreciated that in other embodiments the timing chain 16 may be a timing belt. The variable cam timing system 10 also includes a variable cam timing phaser 18 rotationally coupling the timing chain/belt 16 and the camshaft 12. As shown in FIG. 2, the variable cam timing phaser 18 includes a housing 20 having a housing wall 22 disposed about an axis A1 and defining a housing interior 24. The variable cam timing phaser 18 may include an outer plate 64 coupled to the housing 20. The variable cam timing phaser 18 further includes a rotor 26 at least partially disposed within the housing interior 24 and moveable with respect to the housing 20. The rotor 26 has a hub 28 and a plurality of vanes 30 extending from the hub 28 away from the axis A1 toward the housing wall 22. The rotor 26 and the housing 20 define an advance chamber 29 and a retard chamber 31, as shown in FIG. 3. The rotor 26 is moveable between an advance position and a retard position. The variable cam timing phaser 18 also includes a control valve assembly 32.

The control valve assembly 32 includes a valve housing 34 extending along an axis A1 and defining a valve housing interior 37. The valve housing 34 typically has a body portion 40 defining the valve housing interior 37, and an engagement portion 42 configured to engage the camshaft 12. Typically, the engagement portion 42 is threaded for engaging the camshaft 12. When installed in the variable cam timing system 10, the engagement portion 42 of the valve housing 34 may engage the camshaft 12. It is to be appreciated that the valve housing 34 may be further defined as a center bolt housing or a central valve housing. Although not required, the body portion 40 of the valve housing 34 may have a flange 44 extending away from the axis A1. The flange 44 is typically configured to be received by a tool for securing the control valve assembly 32 to the camshaft 12 or another engine component. In a non-limiting example, the flange 44 may be a hex configuration or a head configuration.

Alternatively, it is to be appreciated that the control valve assembly 32 may be installed in the variable cam timing system 10 such that the valve housing 34 engages an engine component other than the camshaft 12. In non-limiting examples, the control valve assembly 32 may be installed in a cylinder head of the engine, in an engine block of the engine, or even within a hollow center defined by the camshaft 12. When the control valve assembly 32 is installed in the variable cam timing system 10 in a location where the valve housing 34 does not engage the camshaft 12 directly, the control valve assembly 32 is considered to be remote and may be referred to as a remote control valve assembly 32.

The valve housing 34 also defines a supply port (P) for supplying hydraulic fluid to the valve housing interior 37, a first working port (A), a second working port (B), and an exhaust port (T). It is to be appreciated that the exhaust port (T) may be a single exhaust port, or that the exhaust port (T) may be further defined as an advance exhaust port fluidly connectable with the advance chamber 29 and a retard exhaust port fluidly connectable with the retard chamber 31. It is to be appreciated that the advance exhaust port being fluidly connectable with the advance chamber 29 allows fluid, such as hydraulic fluid, to flow between the advance exhaust port and the advance chamber 29. Likewise, it is to be appreciated that the retard exhaust port being fluidly connectable with the retard chamber 31 allows fluid, such as hydraulic fluid, to flow between the retard exhaust port and the retard chamber 31. The first working port (A) is fluidly connectable with one of the advance chamber 29 and the retard chamber 31, and the second working port (B) is fluidly connectable with the other of the advance chamber 29 and the retard chamber 31. For example, the first working port (A) may be fluidly connectable with the advance chamber 29 and the second working port (B) may be fluidly connectable with the retard chamber 31. Likewise, the first working port (A) may be fluidly connectable with the retard chamber 31 and the second working port (B) may be fluidly connectable with the advance chamber 29. It is to be appreciated that the fluidly connecting the first working port (A) to one of the advance chamber 29 and retard chamber 31 and the second working port (B) to the other of the advance chamber 29 and retard chamber 31 allows fluid, such as hydraulic fluid, to selectively flow between the first and second working ports (A, B) and the advance and retard chambers 29, 31. The control valve assembly 32 also includes a piston 36 disposed in the valve housing interior 37 and moveable along the axis A1 for controlling flow of the hydraulic fluid through the valve housing interior 37. The piston 36 may be moveable between a first position associated with the advance position of the rotor 26 and a second position associated with the retard position of the rotor 26. Typically, the piston 36 is moveable in the valve housing interior 37 by an actuator of the variable cam timing phaser 18, such as an electromechanical actuator, a variable force solenoid, and the like. The piston 36 permits selective flow of fluid, such as hydraulic fluid, between the first and second working ports (A, B) and the advance and retard chambers 29, 31.

Figure 4:
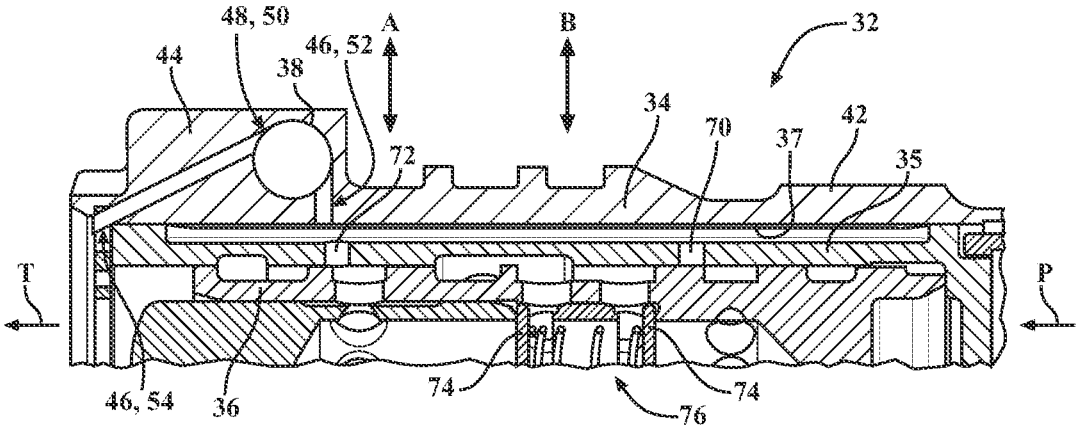
FIG. 4 is a cross-sectional view of the control valve assembly, with the control valve assembly having a valve body having a body portion, and with the vent path having a reservoir defining a reservoir volume.

With reference to FIG. 4, although not required, the control valve assembly 32 may include a control sleeve 35 enclosing the valve housing with respect to the axis A1. In one embodiment, as shown in FIGS. 4-7, 9-11, 14, 16-18, 21-23, and 26-32, the control sleeve 35 may be disposed in the valve housing interior 37. More specifically, the control sleeve 35 may be disposed radially between the valve housing 34 and the piston 36 with respect to axis A1. In another embodiment, although not explicitly shown in the FIGS., the control sleeve 35 may be disposed between the valve housing 34 and the rotor 26. When present, the control sleeve 35 assists in directing the piston 36 through movement of various positions. The control sleeve 35 may be fixed to, or otherwise stationary with respect to, the valve housing 34. Moreover, it is to be appreciated that the control sleeve 35 may be integral (i.e., unitary and one-piece), or may be composed of two or more separate components, such as an inner control sleeve and an outer control sleeve.

In one embodiment, the exhaust port (T) is fluidly connectable with a sump through a vent path 38 that is defined by at least one of the valve housing 34 and the rotor 26. The exhaust port (T) is able to discharge fluid, such as hydraulic fluid, to the sump, and the exhaust port (T) is able to draw fluid, such as air, from outside of the variable cam timing phaser 18. In other embodiments, when the control sleeve 35 is present, the vent path 38 may be defined by the control sleeve 35. It is to be appreciated that in embodiments where the exhaust port (T) is defined as an advanced exhaust port and a retard exhaust port that both the advanced and retard exhaust ports may be fluidly connectable with separate vent paths as described with respect to vent path 38 throughout the subject application. For the exhaust port (T) to be fluidly connectable with the sump, hydraulic fluid need not be required to move from the sump to the exhaust port (T) so long as hydraulic fluid is capable of moving from the exhaust port (T) to the sump. In other words, during typical operation of the variable cam timing phaser 18, hydraulic fluid is only able to discharge from the vent path 38, through the exhaust port (T), and to the sump, and hydraulic fluid is not drawn from the sump, through the exhaust port (T), and to the vent path 38. Moreover, during typical operation of the variable cam timing phaser 18, hydraulic fluid may be completely exhausted to the sump such that only air is present at the exhaust port (T).

It is to be appreciated that the vent path 38 may be defined by the control sleeve 35, the valve housing 34, and/or the rotor 26. For example, the vent path 38 may be defined exclusively by the valve housing 34, defined exclusively by the rotor 26, or defined exclusively by the control sleeve 35. As another non-limiting example, the vent path 38 may be defined by the valve housing 34 and the rotor 26, the valve housing 34 and the control sleeve 35, or the valve housing 34, the rotor 26, and the control sleeve 35. In the embodiment where the vent path is defined by both the valve housing 34 and the control sleeve 35, as shown for example in FIGS. 26-32, the control sleeve 35 may have an outer control sleeve surface 66 defining the vent path 38, and the valve housing 34 may have an inner valve housing surface 68 delimiting the vent path 38 radially outward with respect to the axis A1.

Typically, the sump is at atmospheric pressure such that the hydraulic fluid exhausting from the exhaust port (T) is able to freely communicate with the sump. During exhausting of hydraulic fluid, the vent path 38 directs hydraulic fluid from the control valve assembly 32 into the sump. The vent path 38 is configured to prevent air, such as from the sump, from being sucked into the variable cam timing phaser 18 through the vent path 38, for example during a torque reversal of the camshaft 12. It is to be appreciated that the vent path 38 is configured to prevent air from alternative areas other than the sump from being sucked into the variable cam timing phaser 18, for example during a torque reversal of the camshaft 12. In other non-limiting examples, the vent path 38 may be configured to prevent air from the outside atmosphere, from a crankcase, from a cylinder, particularly a cylinder head, from an enclosed volume in an engine, particularly where a variable force solenoid is disposed, as well as from the camshaft itself. Accordingly, the vent path 38 is able to prevent ingress of air from one or more of numerous possible sources into the variable cam timing phaser 18 through the vent path 38, for example during a torque reversal of the camshaft, which reduces oscillation of the rotor when rotating between the advance and retard positions. Moreover, the vent path 38 may be completely or partially submerged in hydraulic fluid to facilitate prevention of air from being sucked into the variable cam timing phaser 18 through the vent path 38, for example during a torque reversal of the camshaft 12.

During operation of the variable cam timing phaser 18, hydraulic fluid is selectively introduced into the advance chamber 29 or the retard chamber 31 to rotate the rotor 26 into the advance or retard position to selectively apply torque to the camshaft 12. During rotational movement of the rotor 26, hydraulic fluid, typically under pressure, may be exhausted from the cam timing phaser 18 through the vent path 38.

When introducing hydraulic fluid into the advance chamber 29 to move the rotor 26 to the advance position, for example, the variable cam timing phaser 18 may experience a torque reversal causing the rotor 26 to oscillate toward the retard position. More specifically, when advancing the variable cam timing phaser 18, the hydraulic fluid in the retard chamber 31 is pressurized by the camshaft torque. The pressurized hydraulic fluid is either directed to the advance chamber 29 or to the vent path 38 through the control valve assembly 32, thus causing the rotor 26 to rotate toward the advance position. The hydraulic fluid directed to the vent path 38 is then directed to the sump through the exhaust port (T). In such instances, the torque reversal of the camshaft 12 causes a pressure drop in the retard chamber 31 which, under certain circumstances, may draw air from the sump, through the vent path 38 and into the retard chamber. However, because the vent path 38 is configured to prevent air from being sucked into the variable cam timing phaser 18, for example during a torque reversal of the camshaft 12, air is prevented from causing unwanted oscillations of the rotor 26. Said differently, during a torque reversal, the torque applied by the camshaft 12 causes the rotor 26 to rotate toward the retard position, thus causing a pressure drop in the retard chamber 31. The retard chamber 31 being under low-pressure results in hydraulic fluid being drawn into the retard chamber 31 through the vent path 38 because the vent path 38 is at, or near, atmospheric pressure. Ingestion of air, or of a mixture of air and hydraulic fluid, into the retard chamber 31 of the variable cam timing phaser 18 results in unwanted oscillations of the rotor 26 after the torque reversal (e.g., when the camshaft torque of the camshaft 12 is within a normal operating range) because air is able to be easily compressed under pressure. To this end, because the vent path 18 is configured to prevent air from being sucked into the retard or advance chambers 29, 31, only hydraulic fluid is drawn into the retard or advance chambers 29, 31 despite the pressure drop, which prevents unwanted oscillation of the rotor 26. Additionally, having the vent path 38 being completely or partially submerged in hydraulic fluid facilitates prevention of air from being sucked into the variable cam timing phaser 18 through the vent path 38, for example during a torque reversal of the camshaft 12, thus reducing oscillations and facilitating smooth rotation of the rotor 26.

Similarly, for example, when introducing hydraulic fluid into the retard chamber 31 to move the rotor 26 to the retard position, the variable cam timing phaser 18 may experience a torque reversal causing the rotor 26 to oscillate toward the advance position. More specifically, when retarding the cam timing phaser 18, the hydraulic fluid in the advance chamber 29 is pressurized by the camshaft torque. The pressurized hydraulic fluid is either directed to the retard chamber 31 or to the vent path 38 through the control valve assembly 32, thus causing the rotor 26 to rotate toward the retard position. The hydraulic fluid directed to the vent path 38 is then directed to the sump. In such instances, the torque reversal of the camshaft 12 causes a pressure drop in the advance chamber 29 which, under certain circumstances, draw hydraulic fluid, in a non-limiting example from the sump, through the vent path 38 and into the advance chamber 29.

More specifically, during a torque reversal of the camshaft 12, the torque applied by the camshaft 12 causes the rotor 26 to rotate toward the advance position, thus causing a pressure drop in the advance chamber 29. The advance chamber 29 being under low-pressure results in hydraulic fluid or air being drawn into the advance chamber 29 through the vent path 38 because the vent path 38 is at, or near, atmospheric pressure. Ingestion of air, or of a mixture of air and hydraulic fluid, into the advance chamber 29 of the variable cam timing phaser 18 results in unwanted oscillations of the rotor 26 after the torque reversal (e.g., when the camshaft torque of the camshaft 12 is within a normal operating range) because air is able to be easily compressed under pressure.

Despite the pressure drop in the advance chamber 29 in the above example, the rotor 26 is able to rotate smoothly with reduced oscillation because the vent path 38 is configured to prevent air from being sucked into the variable cam timing phaser 18 through the vent path 38, for example during a torque reversal of the camshaft 12, which prevents oscillation of the rotor 26. The vent path 38 being completely or partially submerged in hydraulic fluid facilitates prevention of air from being sucked into the variable cam timing phaser 18 through the vent path 38, for example during a torque reversal of the camshaft 12, thus reducing oscillations and facilitating smooth rotation of the rotor 26.

When present, the control sleeve 35 may define a first vent hole 72 leading to the vent path 38 defined by at least one of the control sleeve 35, the valve housing 34, and the rotor 26, and may define a second vent hole 70 leading to the vent path 38 defined by at least one of the control sleeve 35, the valve housing 34, and the rotor 26. Disposed within the control sleeve 35 may be a check valve 74. The check valve 74 may have one, two, or more than two check discs configured to permit flow of hydraulic fluid in a first direction and restrict flow of hydraulic fluid in a second direction opposite the first direction. It is to be appreciated that each check disc may have a corresponding biasing member, such as a spring, that is configured to bias the check disc toward restricting flow of hydraulic fluid in the second direction. The control sleeve 35 may also define a recirculation chamber 76. In embodiments where present, the first vent hole 72, the second vent hole 70, the check valve 74, and the recirculation chamber 76, in combination with other elements disclosed herein, collectively form an iCTA variable cam timing phaser.

The first vent hole 72 may be fluidly connectable with the first working port (A) leading to the advance chamber 29. The second vent hole 70 may be fluidly connectable with the second working port (B) leading to the retard chamber 31. When the camshaft 12 experiences a torque reversal and the piston 36 is in the second position, hydraulic fluid in the advance chamber 29 is pressurized. A portion of the high-pressure hydraulic fluid in the advance chamber 29 is directed to the check valve 74 and a portion of the high-pressure hydraulic fluid is directed to the first vent hole 72. The portion of the high-pressure hydraulic fluid directed to the first vent hole 72 passes through the first vent hole 72 to the vent path 38. The portion of the high-pressure hydraulic fluid directed to the check valve 74 contacts the check valve 74, passing through the check valve 74 and into the recirculation chamber 76 where the hydraulic fluid is combined with additional hydraulic fluid from the sump supplied through supply port (P). More specifically, the portion of the hydraulic fluid directed to the check valve 74 contacts the check disc, forcing the check disc against the biasing member toward permitting flow of hydraulic fluid in the first direction and into the recirculation chamber 76. Thus, the hydraulic fluid that passes through the check valve 74 is recirculated hydraulic fluid.

Once combined with additional hydraulic fluid from the sump, the hydraulic fluid is directed to the retard chamber 31, thus moving the rotor 26 toward the retard position. Once the pressure of the hydraulic fluid in the recirculation chamber 76 is equal to, or greater than, the pressure of hydraulic fluid in the advance chamber 29, the check valve 74 closes. The closure of the check valve 74 may also be assisted by the biasing member, such as the spring, biasing the check disc toward restricting flow of hydraulic fluid in the second direction. During a torque reversal of the camshaft 12, the pressure of hydraulic fluid in the retard chamber 31 is high and the pressure of hydraulic fluid in the advance chamber 29 is low. In this scenario, hydraulic fluid cannot be driven back into the advance chamber 29 because the check valve 74 is restricting flow of hydraulic fluid in the second direction (i.e., the check valve 74 is closed). Moreover, the piston 16 prevents hydraulic fluid from flowing out of the second vent hole 70. However, hydraulic fluid can be drawn into the advance chamber 29 through the first vent hole 72, which is drawn through vent path 38. If the volume of hydraulic fluid drawn back into the advance chamber 29 is greater than the volume of hydraulic fluid present in the vent path 38, then air will also be drawn into the advance chamber 29, which results in a decreased performance due to oscillation of the rotor 26.

When the camshaft 12 experiences a torque reversal and the piston 36 is in the first position, hydraulic fluid in the retard chamber 31 is pressurized. A portion of the high-pressure hydraulic fluid in the retard chamber 31 is directed to the check valve 74 and a portion of the high-pressure hydraulic fluid is directed to the second vent hole 70. The portion of the high-pressure hydraulic fluid directed to the second vent hole 70 passes through the second vent hole 70 to the vent path 38. The portion of the high-pressure hydraulic fluid directed to the check valve 74 contacts the check valve 74, passing through the check valve 74 and into the recirculation chamber 76 where the hydraulic fluid is combined with additional hydraulic fluid from the sump supplied through supply port (P). More specifically, the portion of the hydraulic fluid directed to the check valve 74 contacts the check disc, forcing the check disc against the biasing member toward permitting flow of hydraulic fluid in the first direction and into the recirculation chamber 76. Thus, the hydraulic fluid that passes through the check valve 74 is recirculated hydraulic fluid.

Once combined with additional hydraulic fluid from the sump, the hydraulic fluid is directed to the advance chamber 29, thus moving the rotor 26 toward the advance position. Once the pressure of the hydraulic fluid in the recirculation chamber 76 is equal to, or greater than, the pressure of hydraulic fluid in the retard chamber 31, the check valve 74 closes. The closure of the check valve 74 may also be assisted by the biasing member, such as the spring, biasing the check disc toward restricting flow of hydraulic fluid in the second direction. During a torque reversal of the camshaft 12, the pressure of hydraulic fluid in the advance chamber 29 is high and the pressure of hydraulic fluid in the retard chamber 31 is low. In this scenario, hydraulic fluid cannot be driven back into the retard chamber 31 because the check valve 74 is restricting flow of hydraulic fluid in the second direction (i.e., the check valve 74 is closed). Moreover, the piston 16 prevents hydraulic fluid from flowing out of the first vent hole 72. However, hydraulic fluid can be drawn into the retard chamber 31 through the second vent hole 70, which is drawn through vent path 38. If the volume of hydraulic fluid drawn back into the retard chamber 31 is greater than the volume of hydraulic fluid present in the vent path 38, then air will also be drawn into the retard chamber 31, which results in a decreased performance due to oscillation of the rotor 26. Thus, more benefits are provided for the vent path 38 being configured to prevent air from being sucked into the variable cam timing phaser 18 through the vent path 38, for example during a torque reversal of the camshaft 12, in the embodiments where the variable cam timing phaser 18 is an iCTA variable cam timing phaser, as described above.

In one embodiment, the control valve assembly 32 may be free of a check valve in the vent path 38. Said differently, the variable cam timing phaser may have no check valve disposed in or coupled to the vent path 38. For example, typical check valves are moveable between an open position for allowing the flow of hydraulic fluid, and a closed position restricting the flow of hydraulic fluid. In other words, typical check valves are mechanical check valves that are moveable between an open and closed position based on the pressure and/or the flow of hydraulic fluid in the vent path 38. Examples of check valves include mechanical check valves, a ball check valve, a flapper check valve, a disc check valve, a band check valve, and the like. Because the vent path 38 is configured to prevent air from being sucked into the variable cam timing phaser 18 through the vent path 38, for example during a torque reversal of the camshaft 12, the control valve assembly 32 may be free of a check valve, such as the exemplary check valves listed above, in the vent path 38. The control valve assembly 32 being free of a check valve in the vent path 38 eliminates a component of the control valve assembly 32 that is susceptible to decreased performance from repeated use. Moreover, the control valve assembly 32 being free of a check valve in the vent path 38 reduces the number of components required in the control valve assembly 32, reducing the cost of the variable cam timing phaser 18.

Figure 11:
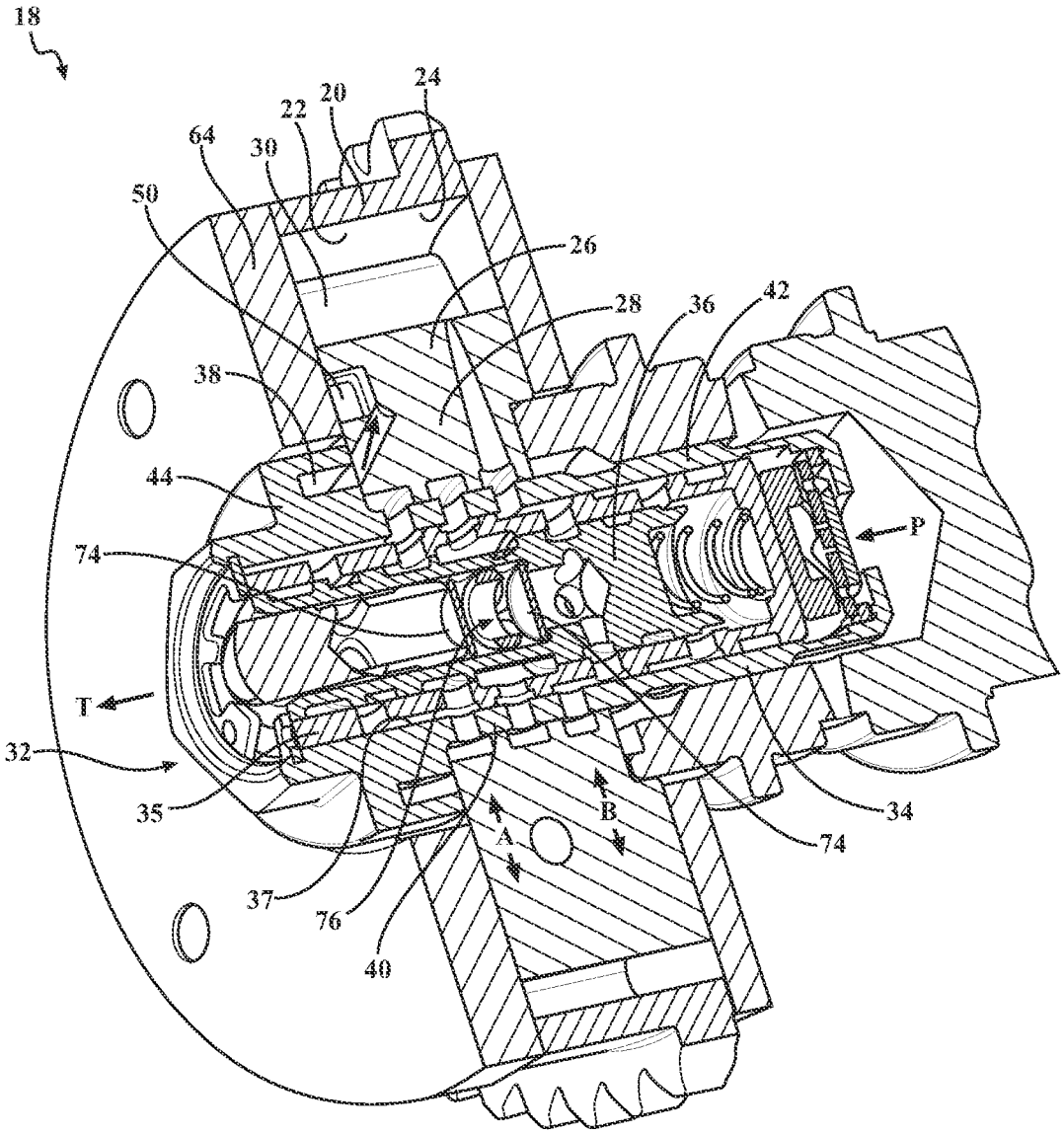
FIG. 11 is a cross-sectional view of the variable cam timing phaser of FIG. 10, with the vent path having the reservoir defined by the rotor and an outer plate of the variable cam timing phaser.
Figure 12:
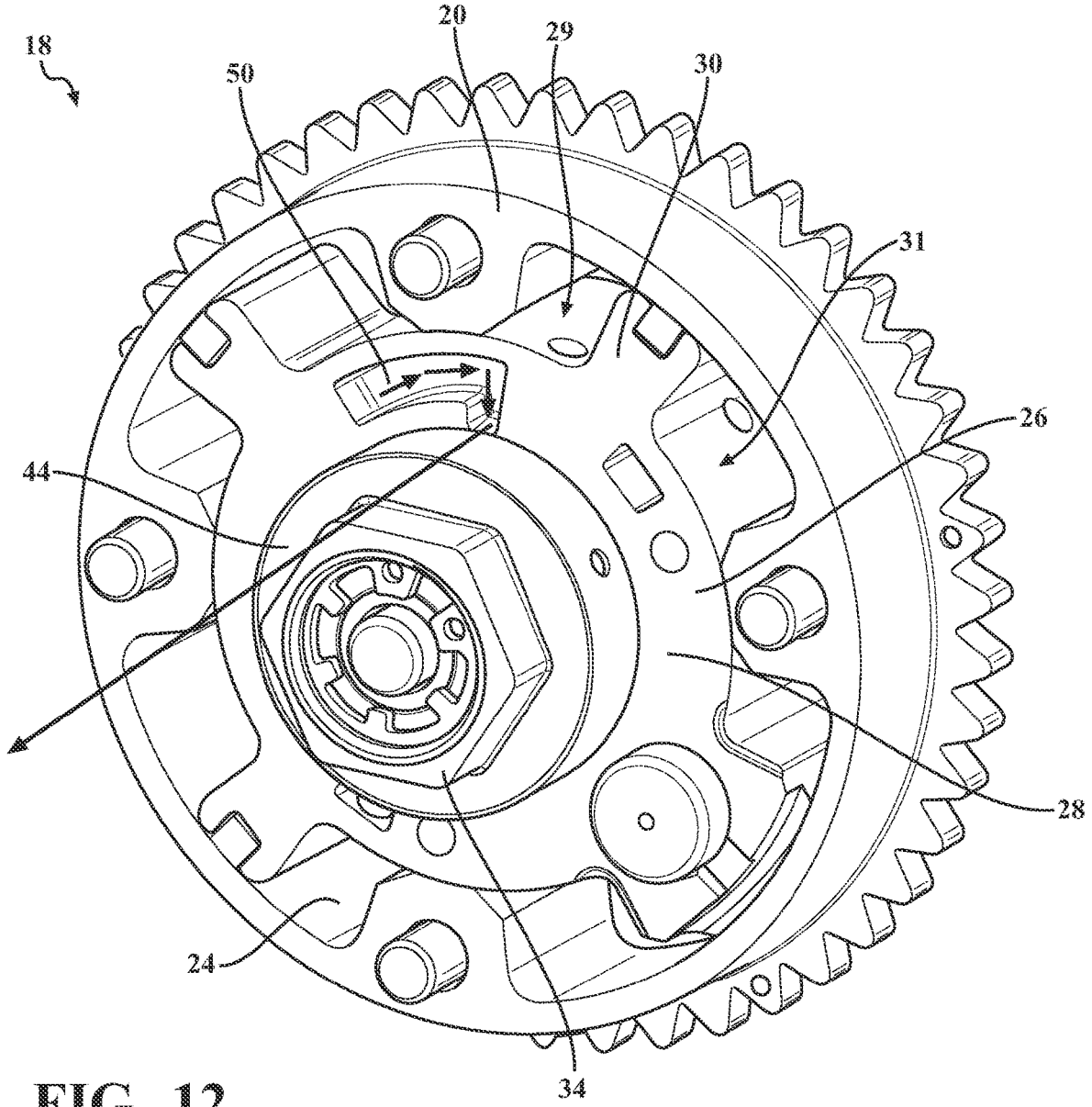
FIG. 12 is a perspective view of the variable cam timing phaser of FIGS. 10 and 11 with the outer plate removed.
Figure 13:
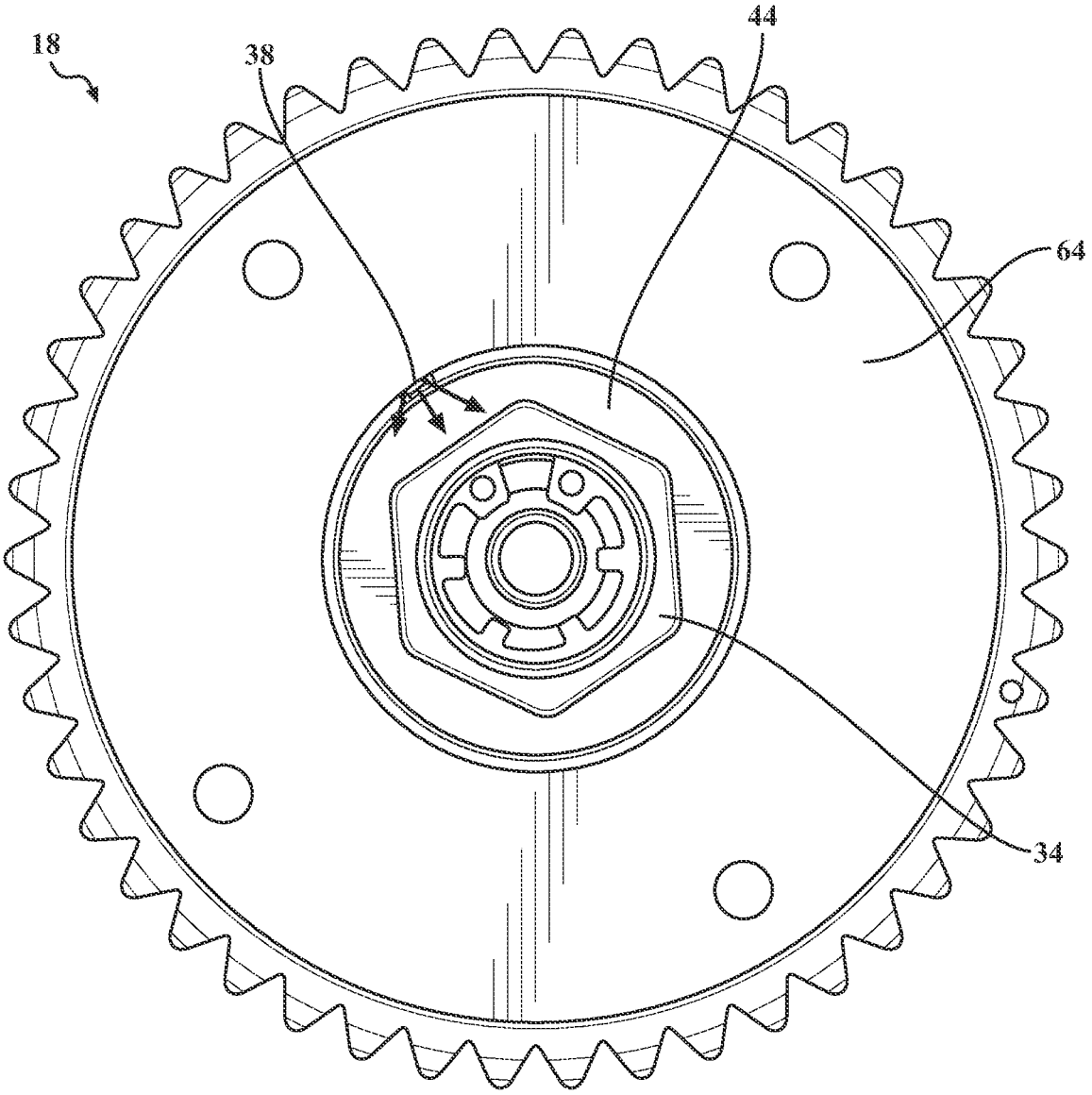
FIG. 13 is a frontal view of the variable cam timing phaser of FIGS. 10-12, with hydraulic fluid being discharged from the reservoir.
Figure 14:
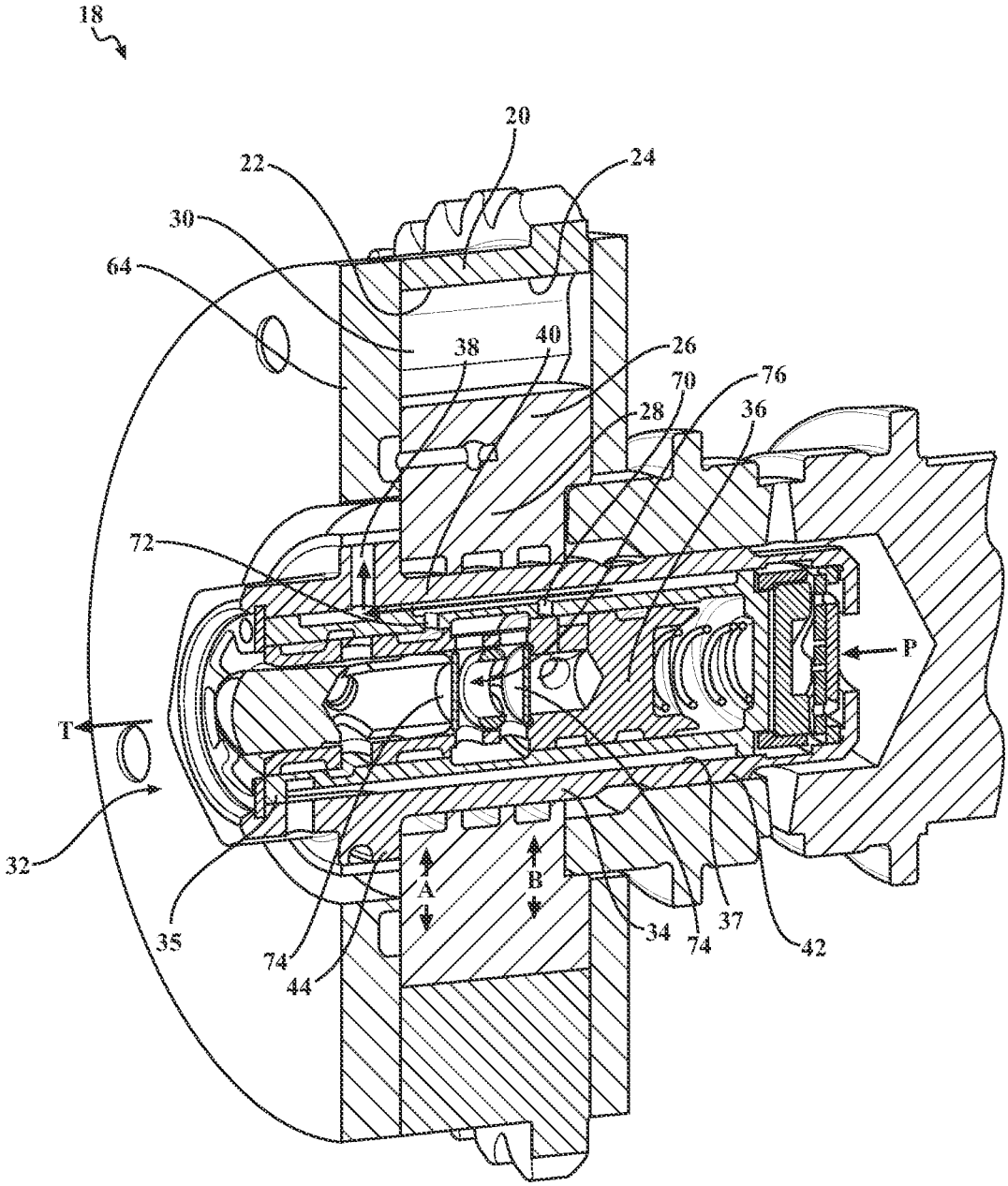
FIG. 14 is a cross-sectional view of another embodiment of the variable cam timing phaser, with control valve assembly further including a control sleeve, and with the control sleeve defining the vent path.
Figure 15:
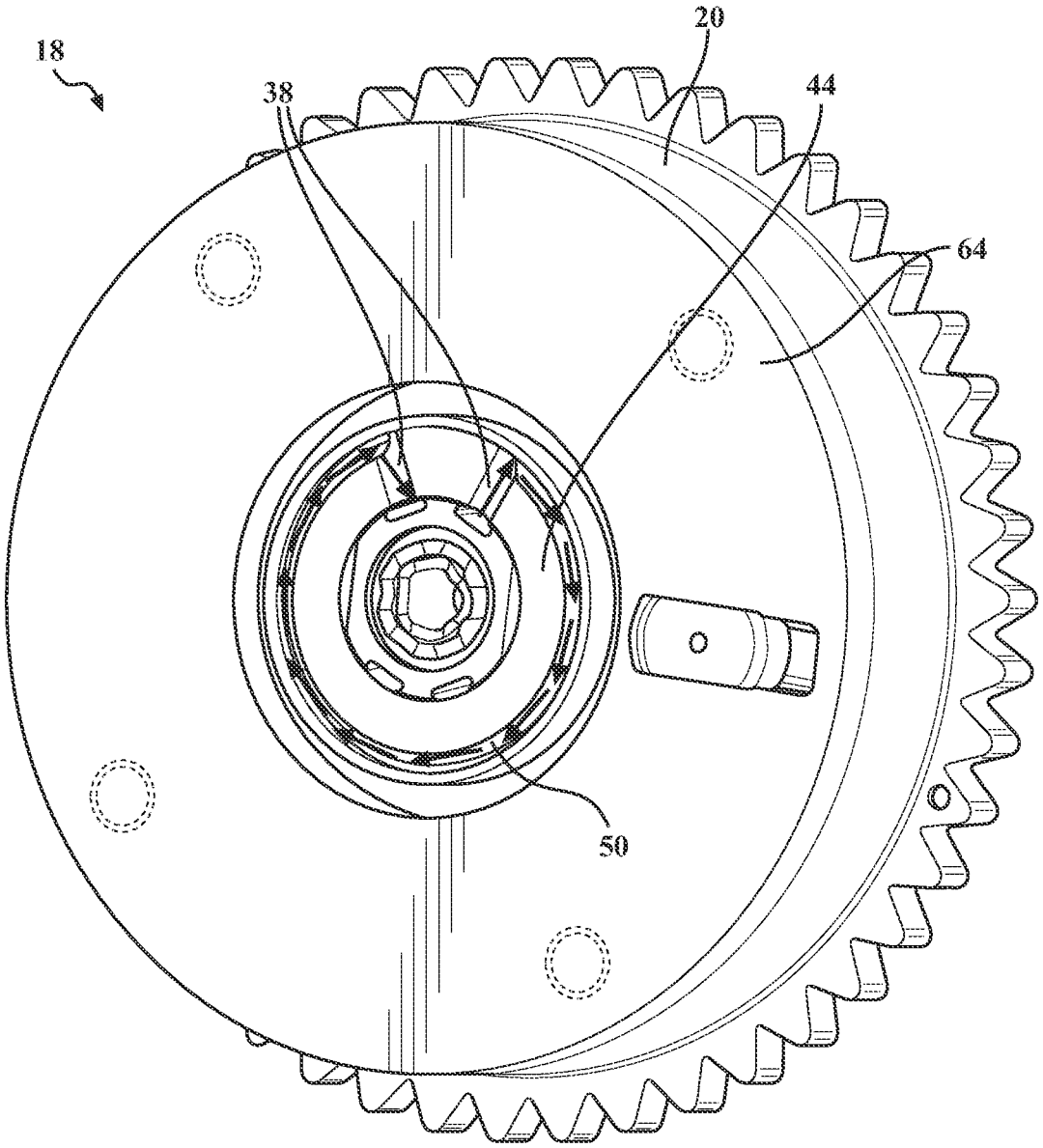
FIG. 15 is a perspective view partially in cross-section of the variable cam timing phaser of FIG. 14.
Figure 16:
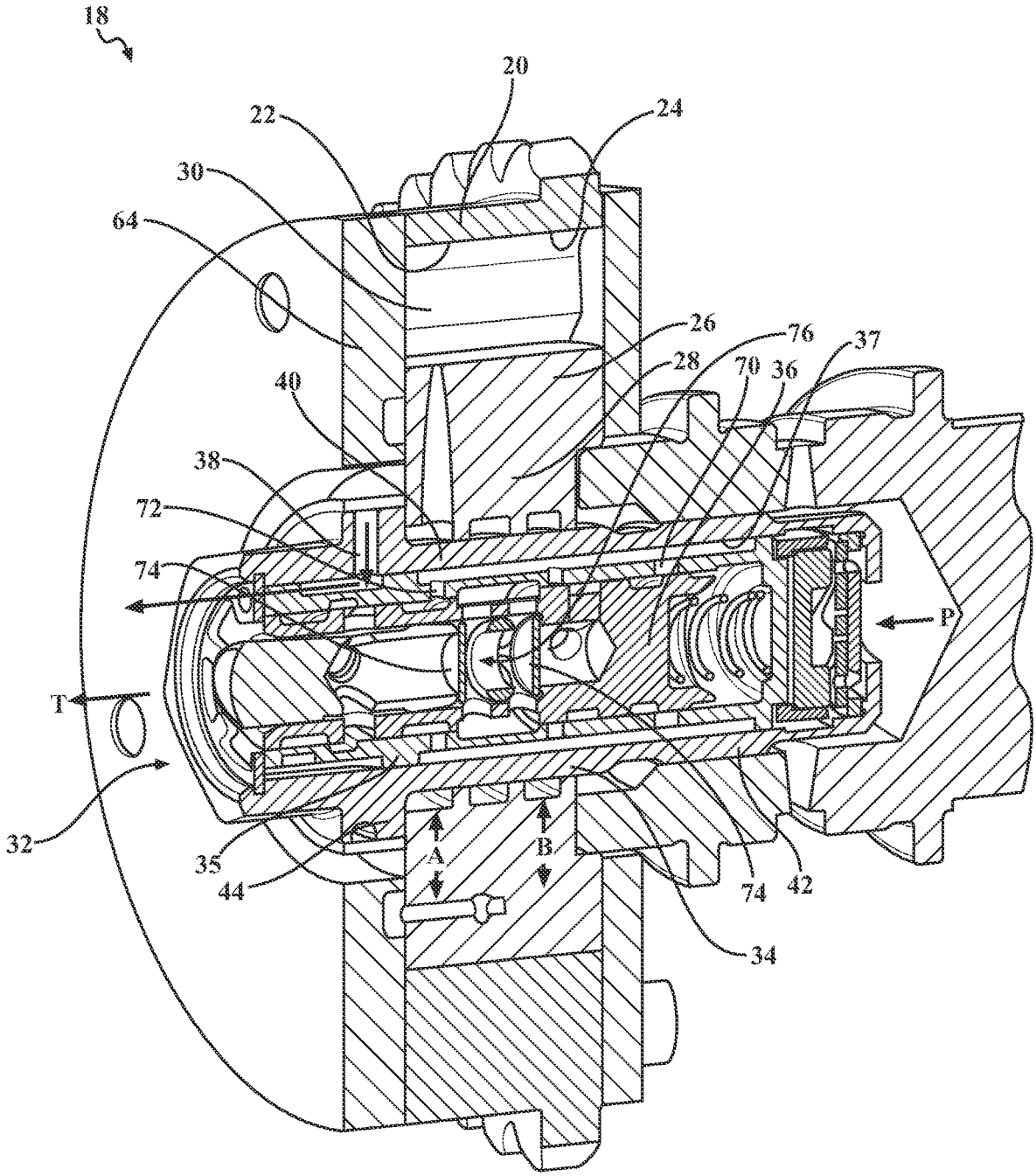
FIG. 16 is a cross-sectional view of the variable cam timing phaser of FIGS. 14 and 15.
Figure 17:
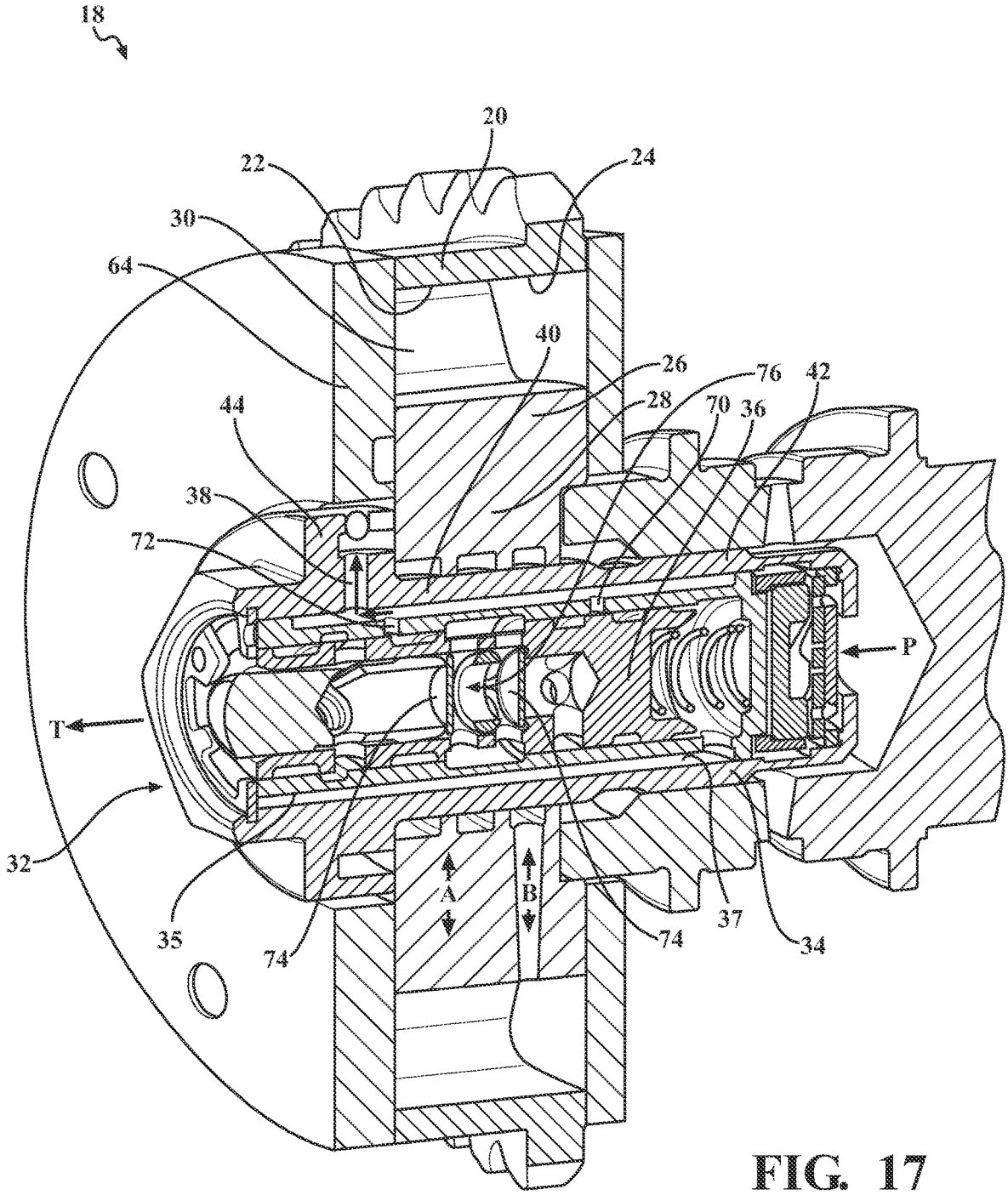
FIG. 17 is a cross-sectional view of another embodiment of the variable cam timing phaser, with the vent path defined by the control sleeve.
Figure 18:
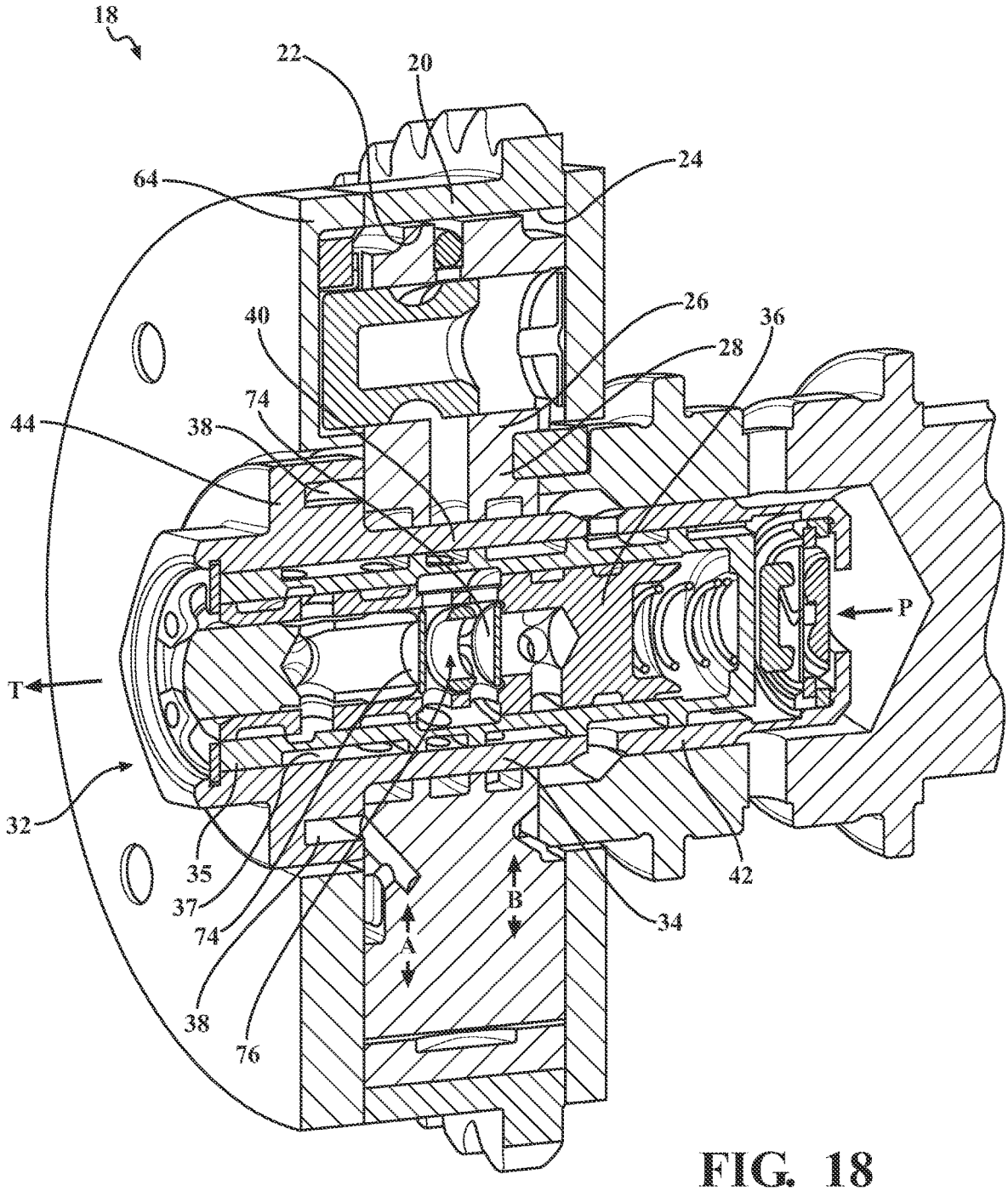
FIG. 18 is cross-sectional view of the variable cam timing phaser of FIG. 17, with the vent path also being defined by the rotor.

The vent path 38 may lead to a reservoir 50. The reservoir 50 may be configured to hold a volume of hydraulic fluid. The reservoir 50 may be completely or partially submerged in hydraulic fluid to facilitate prevention of air from being sucked into the variable cam timing phaser 18 through the vent path 38, for example during a torque reversal of the camshaft 12. The reservoir 50 further prevents air from being sucked into the variable cam timing phaser 18 through the vent path 38, for example during a torque reversal of the camshaft 12, because the hydraulic fluid stored in the reservoir 50, rather than air, is sucked back into the variable cam timing phaser 18 toward one of the advance and retard chambers 29, 31. As shown in FIGS. 11, and 12, the reservoir 50 may be defined by the rotor 26. In other embodiments, the reservoir 50 may be collectively defined by the rotor 26 and the outer plate 64. In yet other embodiments, the reservoir 50 may be defined by the control sleeve 35 or by both the control sleeve 35 and the valve housing 34.

Figure 5:
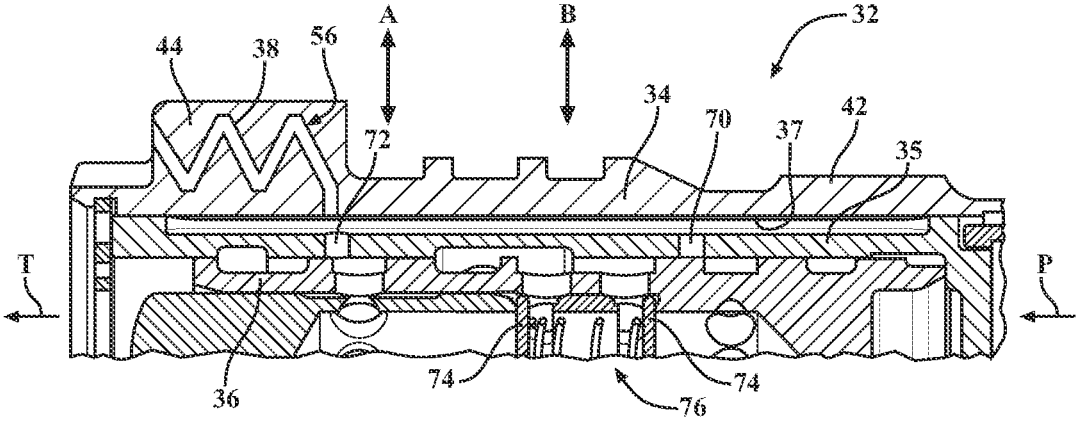
FIG. 5 is a cross-sectional view of another embodiment of the control valve assembly, with the vent path having a zig-zag configuration.
Figure 6:
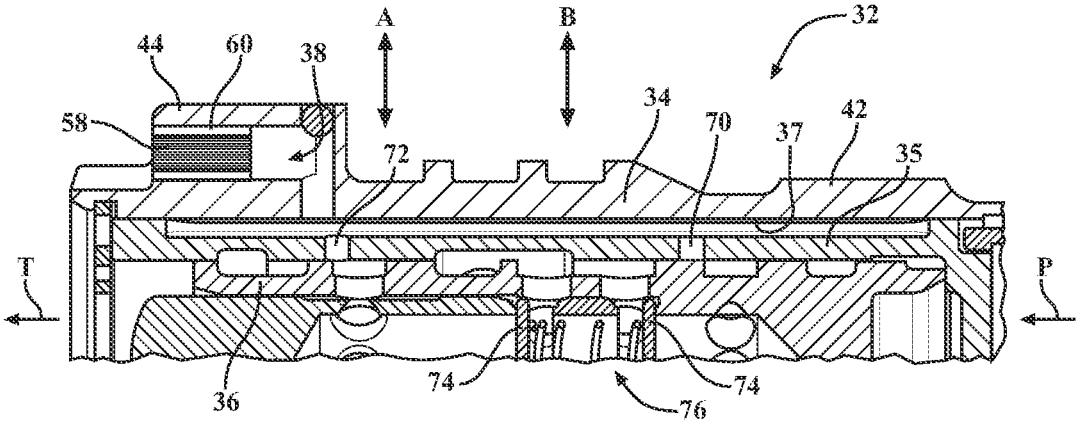
FIG. 6 is a cross-sectional view of another embodiment of the control valve assembly, with the control valve assembly having a restricting member defining a plurality of passages for reducing the flow area to prevent air from a sump from being sucked into the variable cam timing phaser.
Figure 7:
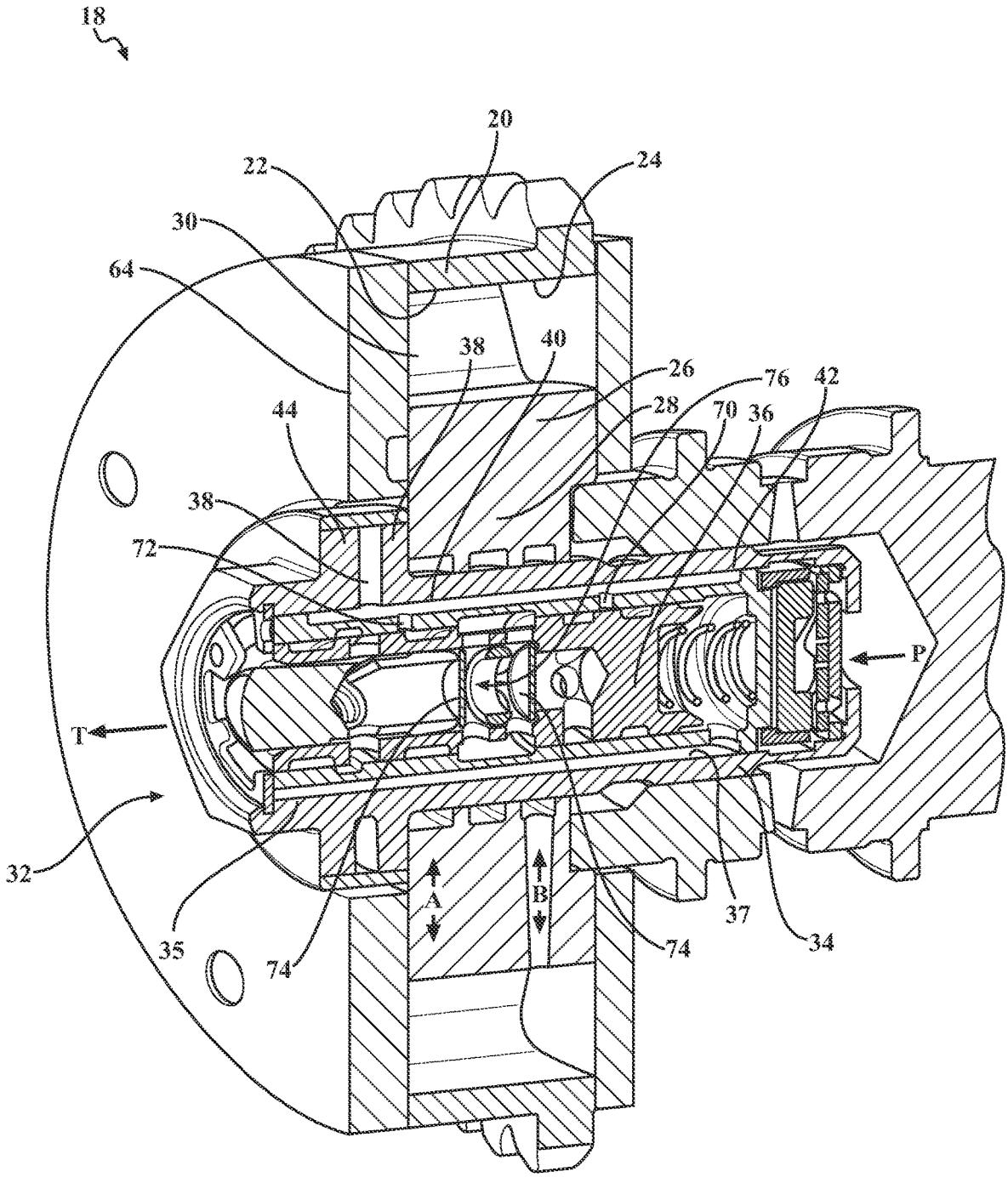
FIG. 7 is a cross-sectional view of another embodiment of the variable cam timing phaser, with the vent path defined the body portion of the control valve assembly.
Figure 8:
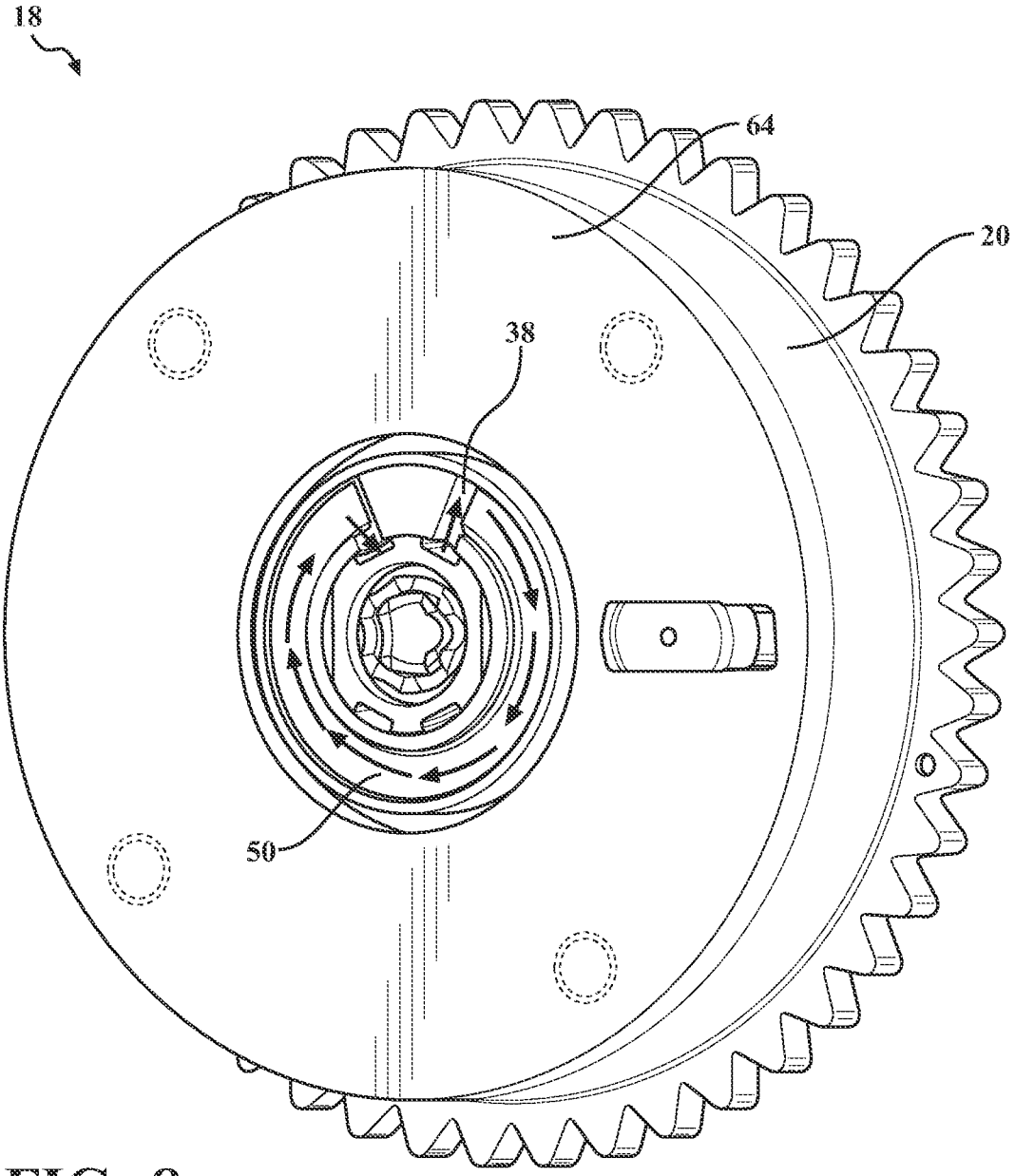
FIG. 8 is a perspective view of the variable cam timing phaser of FIG. 7 with the vent path defined circumferentially about the axis.
Figure 9:
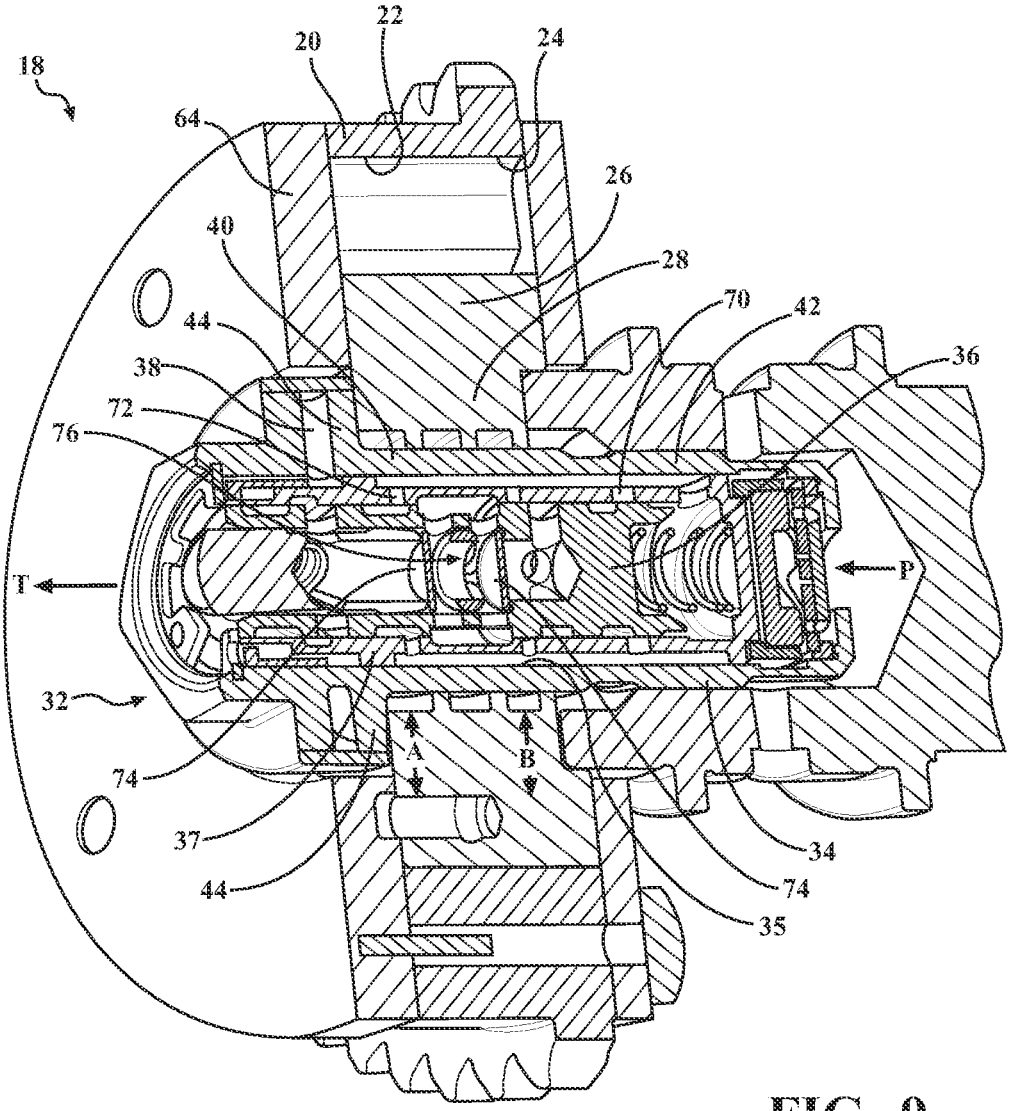
FIG. 9 is a cross-sectional view of the variable cam timing phaser of FIGS. 7 and 8, with the vent path discharging hydraulic fluid to the exhaust port.
Figure 10:
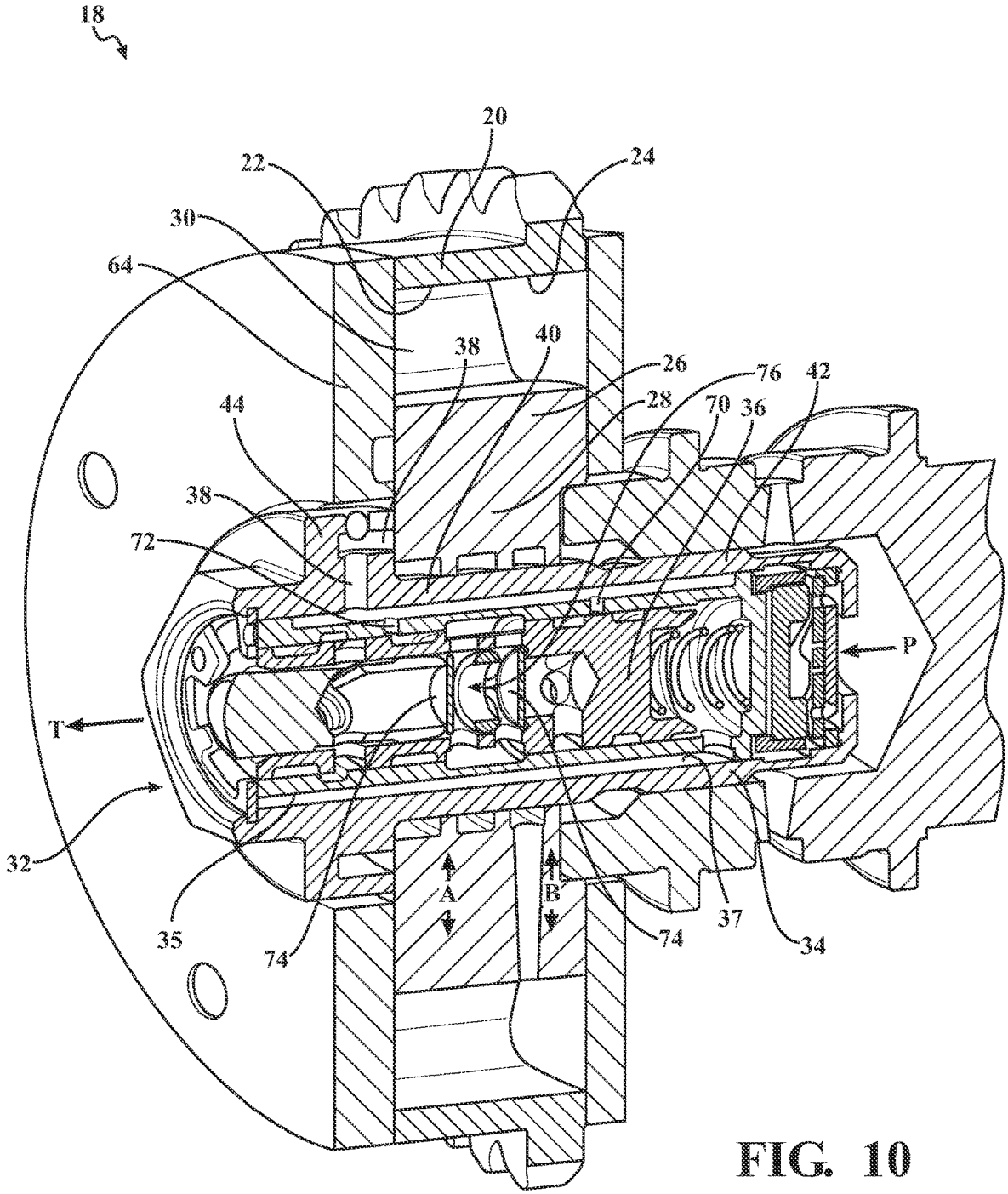
FIG. 10 is a cross-sectional view of another embodiment of the variable cam timing phaser, with the vent path defined at least partially by the body portion of the control valve assembly.

As shown in FIGS. 4-6, the vent path 38 may be defined exclusively by the valve housing 34. In other words, the valve housing 34 may be the only component of the variable cam timing phaser 18 that defines the vent path 38. It is to be appreciated that the valve housing 34 may be multiple components and may still exclusively define the vent path 38.

The vent path 38 may be defined by the body portion 40 of the valve housing 34, as shown in FIGS. 4-7, 9-11, 14, 16-18, and 21-23. In the embodiments where the body portion 40 of the valve housing 34 has the flange 44, the vent path 38 may be defined by the flange 44. As shown in FIGS. 11, 12, 18, 19, 23, and 24, the vent path 38 may also be defined by the rotor 26. It is to be appreciated that the vent path 38 may be defined exclusively by the rotor 26 or may be defined by both the rotor 26 and the valve housing 34.

Although not required, as shown in FIGS. 4, 26, 27, and 30, the vent path 38 may have a first vent portion 46 having a first flow area and a second vent portion 48 having a second flow area. The second flow area of the second vent portion 48 may be greater than the first flow area of the first vent portion 46 for preventing air from being sucked into the variable cam timing phaser 18 through the vent path 38, for example during a torque reversal of the camshaft 12. More specifically, the second vent portion 48 may be further defined as the reservoir 50 defining a reservoir volume. In such embodiments, the reservoir 50 may contain hydraulic fluid such that, for example during a torque reversal of the camshaft 12, hydraulic fluid from the reservoir 50, rather than air, is sucked back into the variable cam timing phaser 18 toward one of the advance and retard chambers 29, 31. Additionally, the first vent portion 46 shown in FIG. 30 increases the surface tension to further prevent air from being sucked into the variable cam timing phaser 18.

The reservoir volume may be configured to be equivalent to or greater than a volume of hydraulic fluid consumed in the variable cam timing phaser 18 during a torque reversal of the camshaft 12. It is also to be appreciated that the reservoir volume may be configured to be less than the volume of hydraulic fluid consumed in the variable cam timing phaser 18 during a torque reversal of the camshaft 12. For instance, the reservoir volume being configured to be less than the volume of hydraulic fluid consumed in the variable cam timing phaser 18 during a torque reversal of the camshaft 12 may result as a compromise between available packaging space for the reservoir volume and a maximum oscillation requirement. The volume of hydraulic fluid that is consumed during a torque reversal of the camshaft 12 varies based on several factors, such as oil temperature, oil viscosity, oil pressure, internal leakage, engine packaging, and cam torque of the engine. To this end, depending on the application of the variable cam timing phaser 18, the reservoir volume may be adjusted. The reservoir 50 defining the reservoir volume assists in preventing ingress of air during a torque reversal of the camshaft 12 by holding and then supplying the hydraulic fluid needed during a torque reversal of the camshaft 12, all while trapping air in the reservoir 50, which prevents the air from reaching the advance chamber 29 or retard chamber 31. Having the reservoir volume equivalent or greater than a volume of hydraulic fluid consumed during a torque reversal of the camshaft 12 results in hydraulic fluid being sucked into the advance chamber 29 or the retard chamber 31, rather than air, during a torque reversal, which results in reduced oscillation of the rotor 26.

As shown in FIG. 4, the first vent portion 46 may have a radial portion 52 extending radially with respect to axis A1 and fluidly connectable with the valve housing interior 37 to the reservoir 50. The first vent portion 46 may also have a longitudinal portion 54 extending from the reservoir 50 away from the radial portion 52. In one embodiment, the longitudinal portion 54 extends at an angle of less than 90 degrees from the radial portion 52. In other embodiments, the longitudinal portion 54 extends at an angle of between 30 and 60 degrees from the radial portion 52. The longitudinal portion 54 may also extend at least partially radially inward toward the axis A1 to keep some hydraulic fluid in the reservoir 50 during normal operation of the engine. During operation of the variable cam timing phaser 18, the control valve assembly 32 may be rotating about the axis A1 such that centrifugal forces are exerted on the hydraulic fluid in the reservoir 50 and preventing egress of the hydraulic fluid from the reservoir 50. It is to be appreciated that the radial portion 52 and the longitudinal portion 54 of the first vent portion 46 need not be contiguous. Rather, as shown in FIG. 4, the radial portion 52 and the longitudinal portion 54 of the first vent portion 46 may be broken up by the second vent portion 48 such that the second vent portion 48 is disposed between the radial portion 52 and the longitudinal portion 54 of the first vent portion 46.

Figure 19:
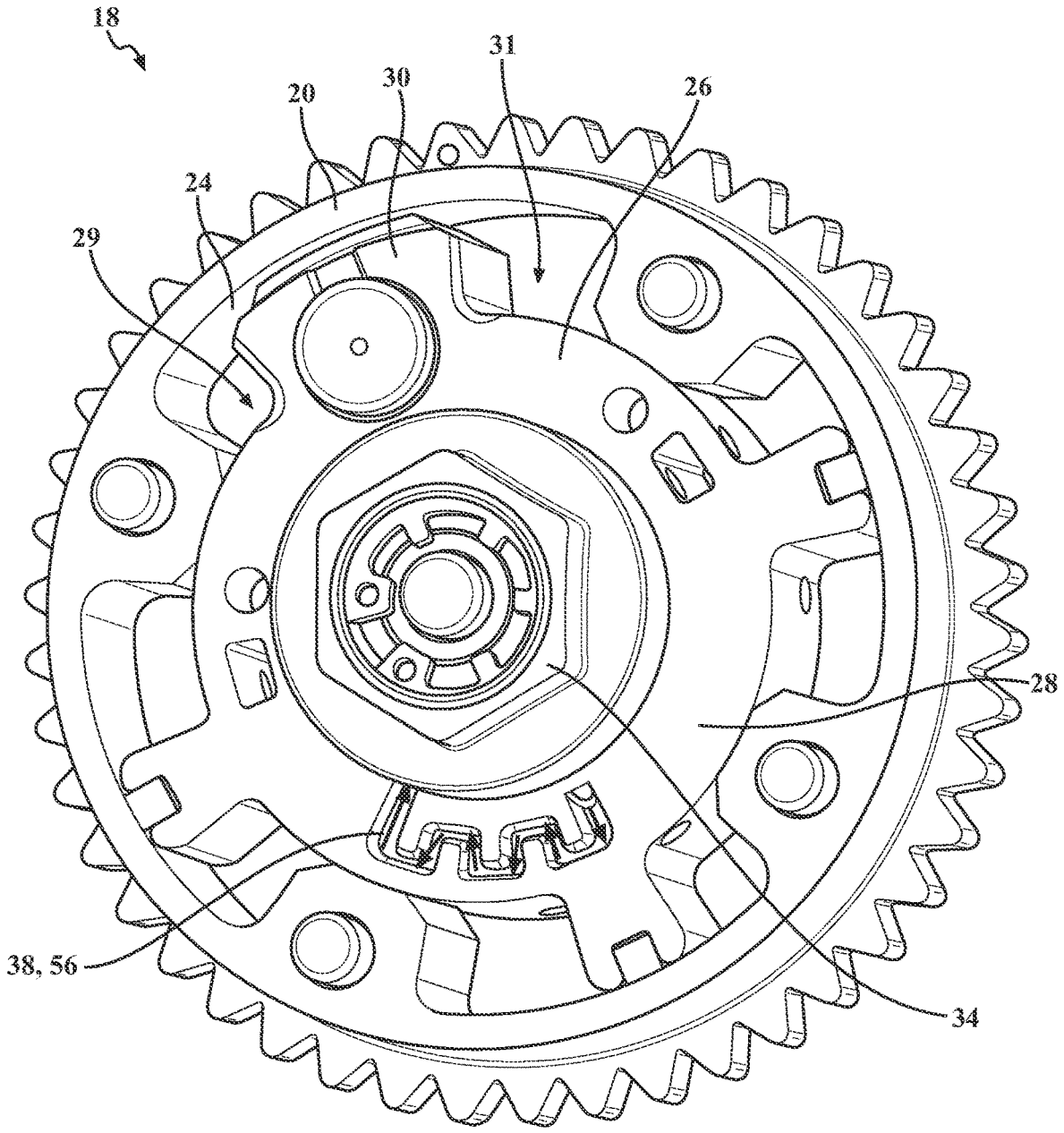
FIG. 19 is perspective view partially in cross-section of the variable cam timing phaser of FIGS. 17 and 18, with the vent path defined by the rotor, and with the vent path having a zig-zag configuration.
Figure 20:
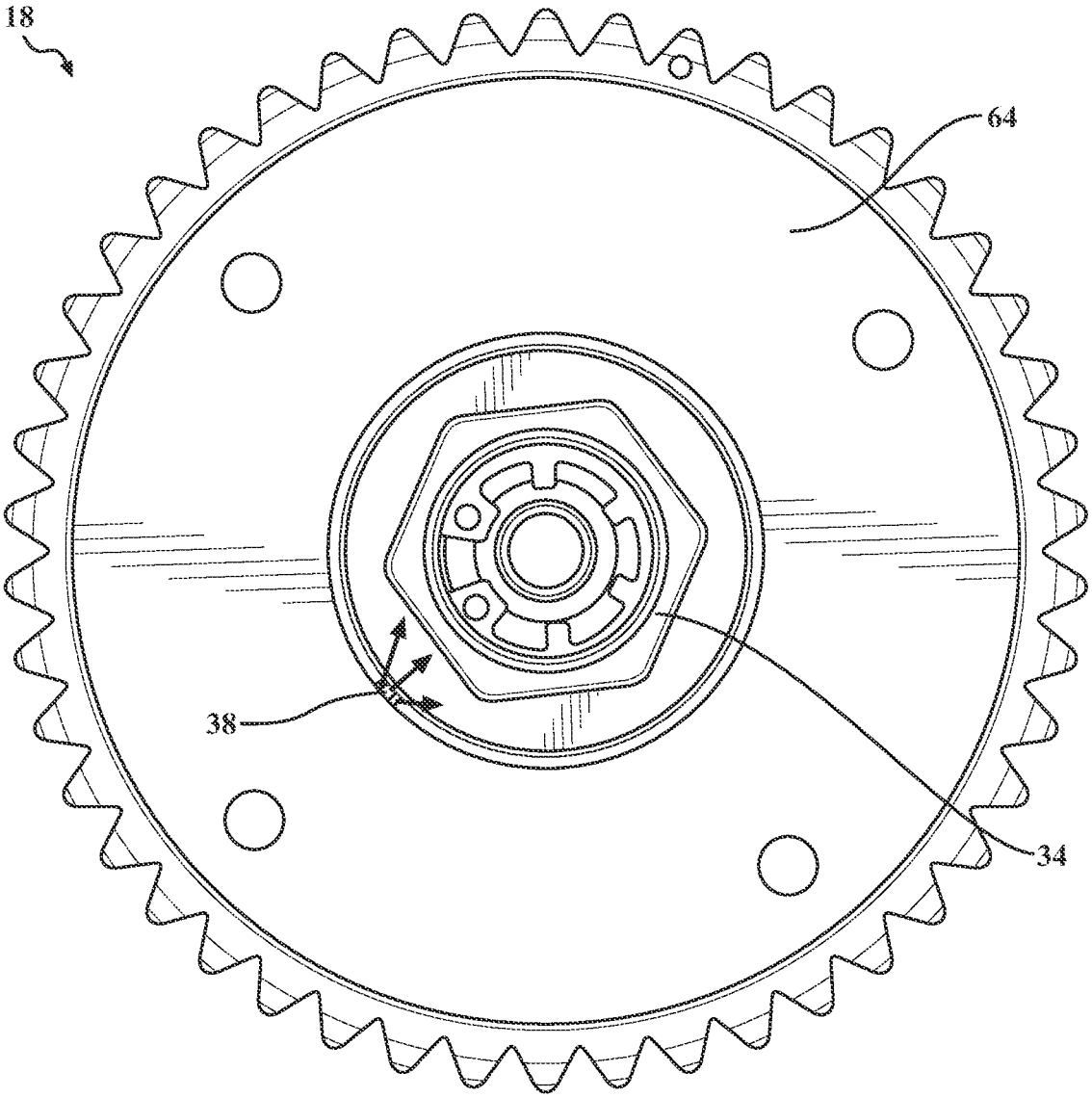
FIG. 20 is a frontal view of the variable cam timing phaser of FIGS. 17-19, with the vent path discharging hydraulic fluid.
Figure 28:
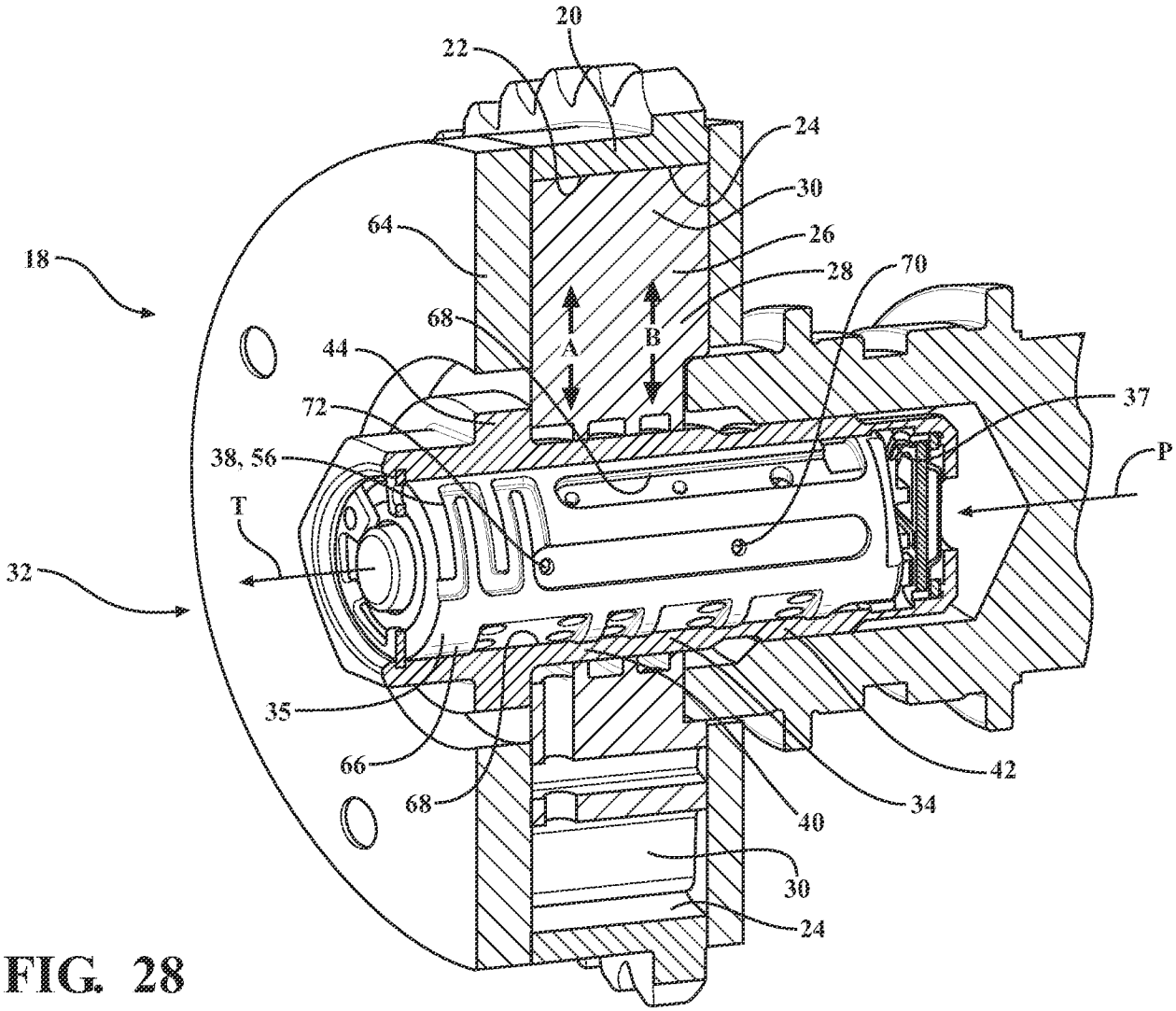
FIG. 28 is a partial cross-sectional view of another embodiment of the variable cam timing phaser, with the control sleeve defining the vent path, and with the vent path having the zig-zag configuration.
Figure 29:
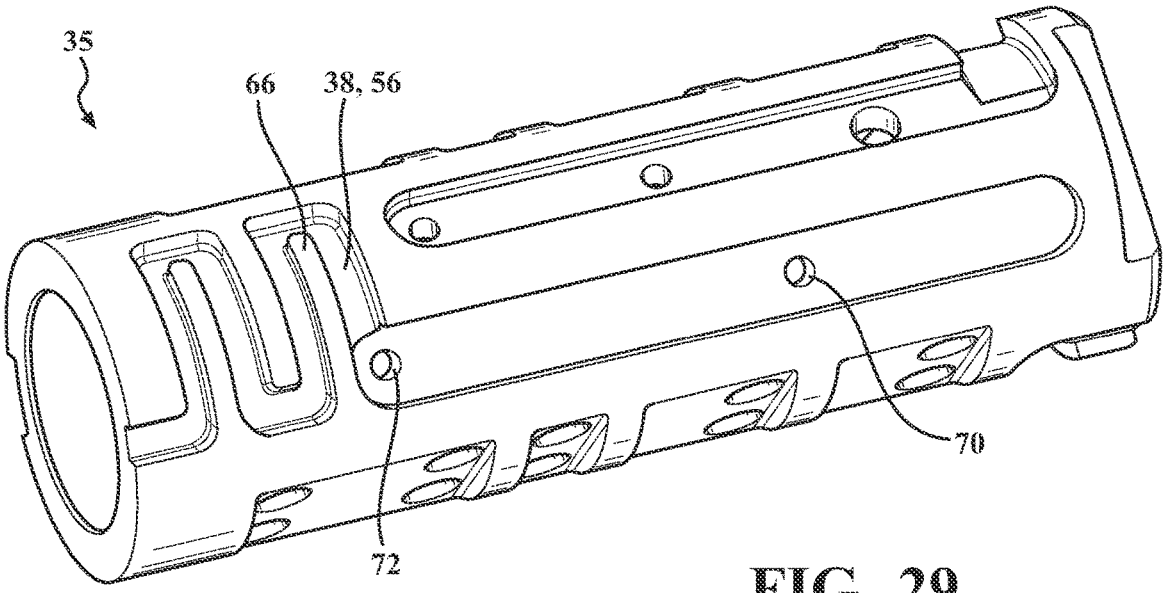
FIG. 29 is a perspective view of the control sleeve of FIG. 28.
Figure 30:
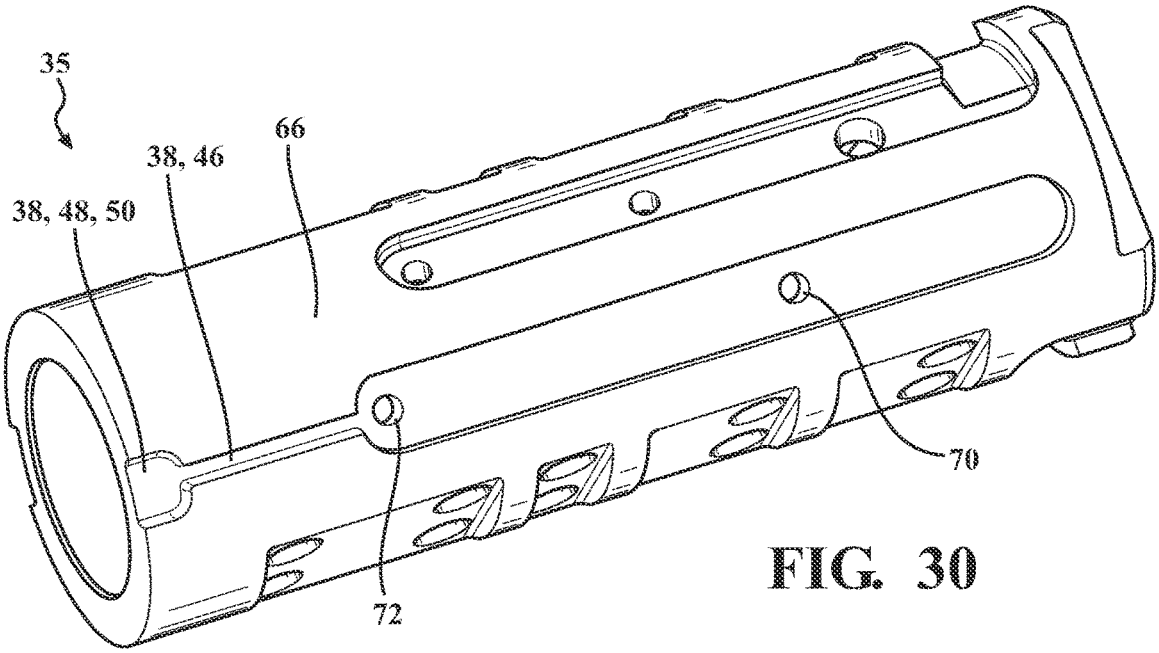
FIG. 30 is a perspective view of another embodiment of the control sleeve defining the vent path, with the vent path having a first vent portion and a second vent portion, with the first vent portion having a first flow area and the second vent portion having a second flow area, and with the second flow area of the second vent portion being greater than the first flow area of the first vent portion.

As shown in FIGS. 5, 17-19, 28, and 29, the vent path 38 may have a zig-zag configuration 56 with respect to the axis A1 for preventing air from being sucked into the variable cam timing phaser 18 through the vent path 38, for example during a torque reversal of the camshaft 12. As shown in FIG. 5, the valve housing 34 defines the vent path 38 having the zig-zag configuration. As shown in FIG. 19, the rotor 26 defines the vent path 38 having the zig-zag configuration. As shown in FIGS. 28 and 29, the control sleeve 35 defines the vent path 38 having the zig-zag configuration. As discussed above, the hydraulic fluid in the vent path 38 is subject to centrifugal forces. In certain embodiments, the zig-zag configuration takes advantage of these centrifugal forces exerted on the hydraulic fluid in the vent path 38 by trapping hydraulic fluid in the radially furthest sections of the vent path 38 with respect to the axis A1, thus acting as a trap to prevent air from passing through the vent path 38. The zig-zag configuration 56 also increases the length of the vent path 38, thus increasing the amount of time required for hydraulic fluid to be drawn into the advance chamber 29 of the variable cam timing phaser 18 and thus limiting the amount of air drawn into the advance chamber 29 of the variable cam timing phaser 18. It is to be appreciated that the zig-zag configuration 56 may be broadly interpreted to encompass a tortious path. Besides the zig-zag configuration, the vent path 38 may have a variety of configurations which increase the length of the vent path 38, thus increasing the amount of time required for hydraulic fluid to be drawn into the advance chamber 29 of the variable cam timing phaser 18 and thus limiting the amount of air drawn into the advance chamber 29 of the variable cam timing phaser 18.

The zig-zag configuration also acts as a reservoir in the vent path 38 due to the additional oil in the increased length of the vent path 38.

It is to be appreciated that a flow area defined by the vent path 38 may be consistent along the vent path 38. Said differently, the flow area may be the same along the length of the vent path 38. In the embodiments where the vent path 38 has the zig-zag configuration 56, the flow area of the vent path 38 in the zig-zag configuration 56 may be consistent along the length of the vent path 38. The vent path 38 may change direction two, three, four, five, six, seven, eight, nine, ten, or more times throughout the course of the zig-zag configuration of the vent path 38.

As shown in FIGS. 6, 21, 24, 31, and 32, the control valve assembly 32 further includes a restricting member 60 for reducing the flow area of the vent path 38 to prevent air from being sucked into the variable cam timing phaser 18, for example during a torque reversal of the camshaft 12. Typically, the restricting member 60 increases the surface area of the vent path 38 through which hydraulic fluid must pass. The increased surface area of the vent path 38 in the restricting member 60 results in increased surface tension of the hydraulic fluid. This increased surface tension of the hydraulic fluid prevents air from passing through the vent path 38.

In one embodiment, as shown in FIG. 6, the restricting member 60 is further defined as a plurality of passages 58 for preventing air from being sucked into the variable cam timing phaser 18 through the vent path 38, for example during a torque reversal of the camshaft 12. It is to be appreciated that the restricting member 60 shown in FIG. 6 may also be used in embodiments where the vent path 38 is defined by the control sleeve 35 and/or the rotor 26. When present, the plurality of passages 58 increases the surface area of the vent path 38 through which hydraulic fluid must pass. The increased surface area of the vent path 38 in the plurality of passages 58 results in increased surface tension of the hydraulic fluid. This increased surface tension of the hydraulic fluid prevents air from passing through the vent path 38. It is to be appreciated that the reduced flow area caused by the restricting member 60 and the increased surface area of the vent path may be adjusted based on several factors, such as temperature, viscosity, and pressure of the hydraulic fluid, along with cam torque of the engine. To this end, depending on the application of the variable cam timing phaser 18, the restricting member 60 may be adjusted, such as changing the length and/or flow area of the restricting member 60, to achieve the desired surface tension to prevent air from being sucked into the variable cam timing phaser 18 through the vent path 38, for example during a torque reversal of the camshaft 12.

It is to be appreciated that the restricting member 60 may be integral, i.e., one piece, with the valve housing 34, or may be a separate component from the valve housing 34. Similarly, the restricting member 60 may be integral, i.e., one piece, with the rotor 26, or may be a separate component from the rotor 26. Moreover, the restricting member 60 may be integral, i.e., one piece, with the control sleeve 35, or may be a separate component from the control sleeve 35. When the restricting member 60 is integral with the valve housing 34, the restricting member 60 may be further defined as the plurality of passages 58. The plurality of passages 60 may be machined in the valve housing 34 or formed in the valve housing 34 in any suitable manner. When the restricting member 60 is a separate component from the valve housing 34, the restricting member 60 may comprise a porous material and/or be a plug. Similarly, when the restricting member 60 is integral with the rotor 26, the restricting member 60 may be further defined as the plurality of passages 58. The plurality of passages 58 may be machined in the rotor 26 or formed in the rotor 26 in any suitable manner. When the restricting member 60 is a separate component from the rotor 26, the restricting member 60 may comprise a porous material and/or be a plug. Moreover, when the restricting member 60 is integral with the control sleeve 35, the restricting member 60 may be further defined as the plurality of passages 58. The plurality of passages 58 may be machined in the control sleeve 35 or formed in the control sleeve 35 in any suitable manner.

Figure 21:
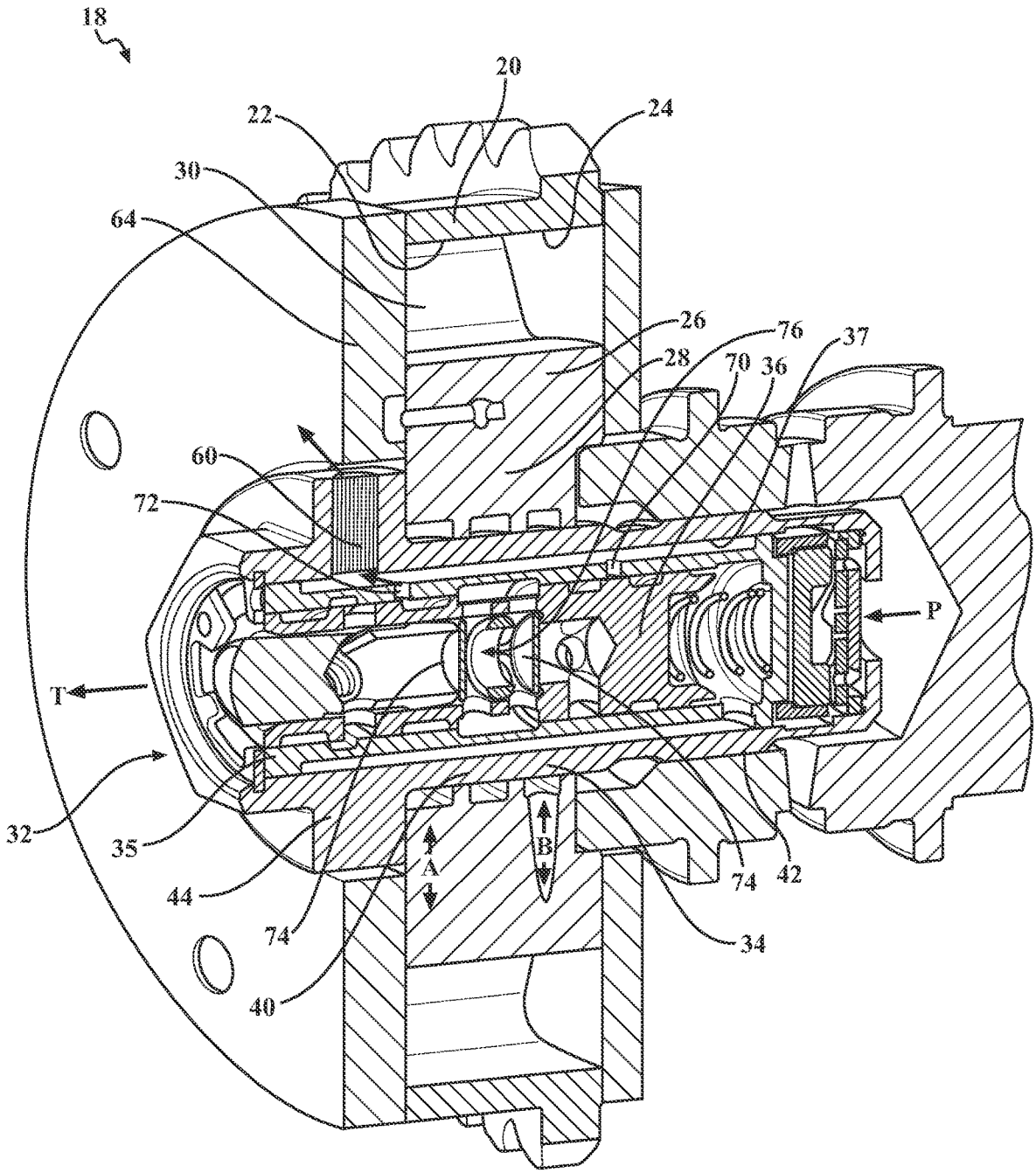
FIG. 21 is a cross-sectional view of another embodiment of the variable cam timing phaser, with the control valve assembly including a restricting member disposed in the vent path.
Figure 22:
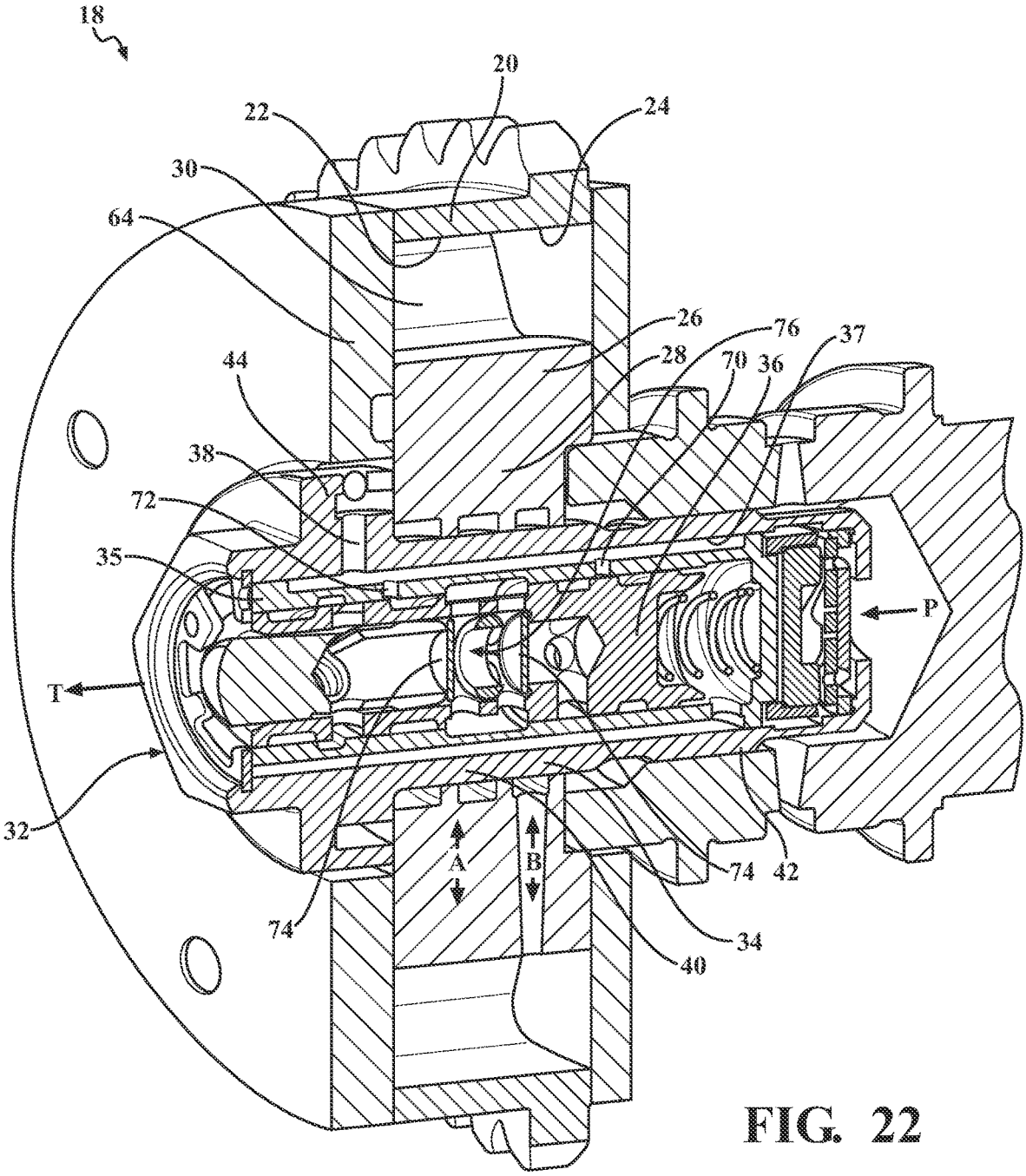
FIG. 22 is a cross-sectional view of another embodiment of the variable cam timing phaser.
Figure 23:
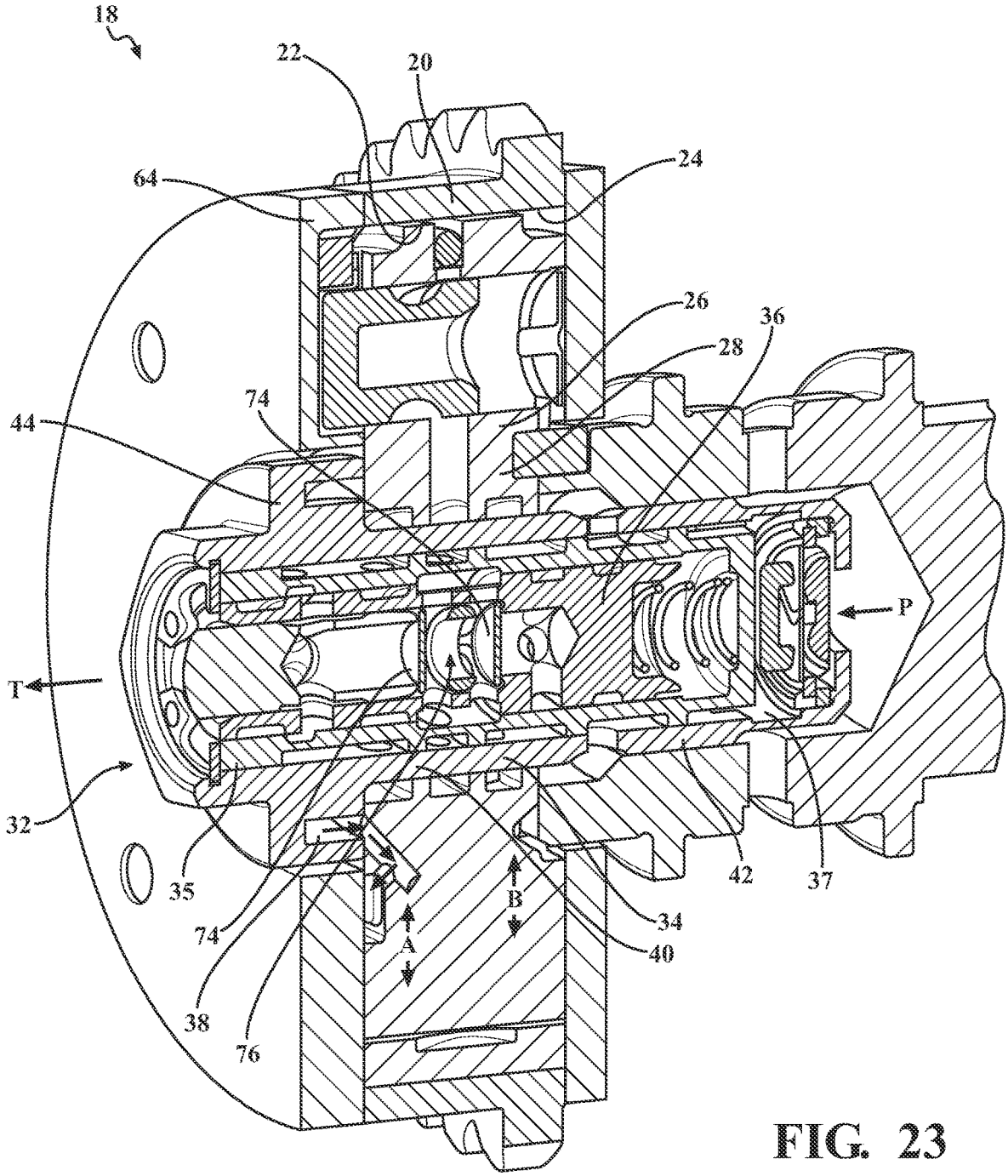
FIG. 23 is a cross-sectional view of the variable cam timing phaser of FIG. 22, with the vent path defined by the rotor.
Figure 24:
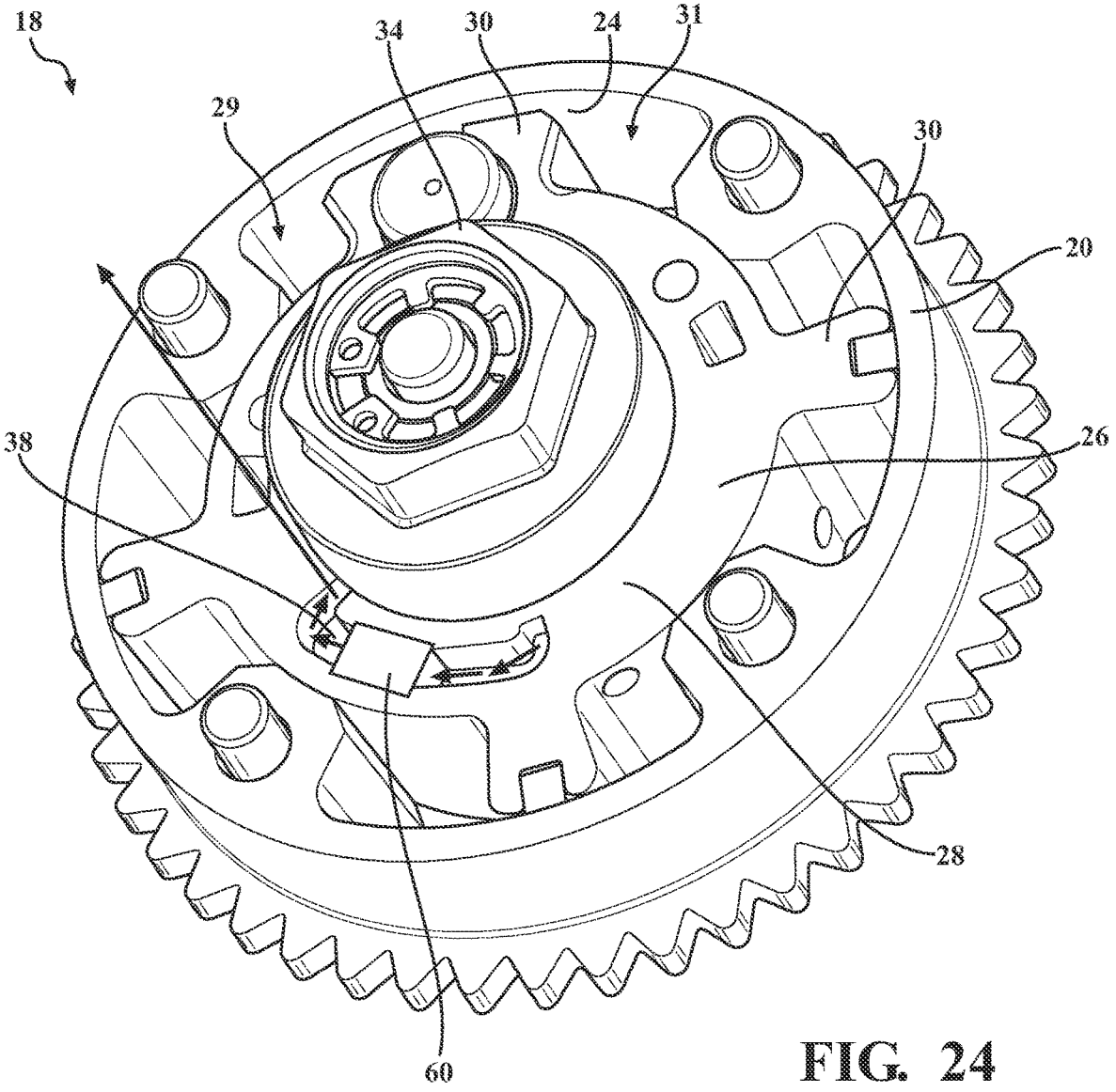
FIG. 24 is a perspective view of the variable cam timing phaser of FIGS. 22 and 23, with the control valve assembly including a restricting member disposed in the vent path defined by the rotor.
Figure 25:
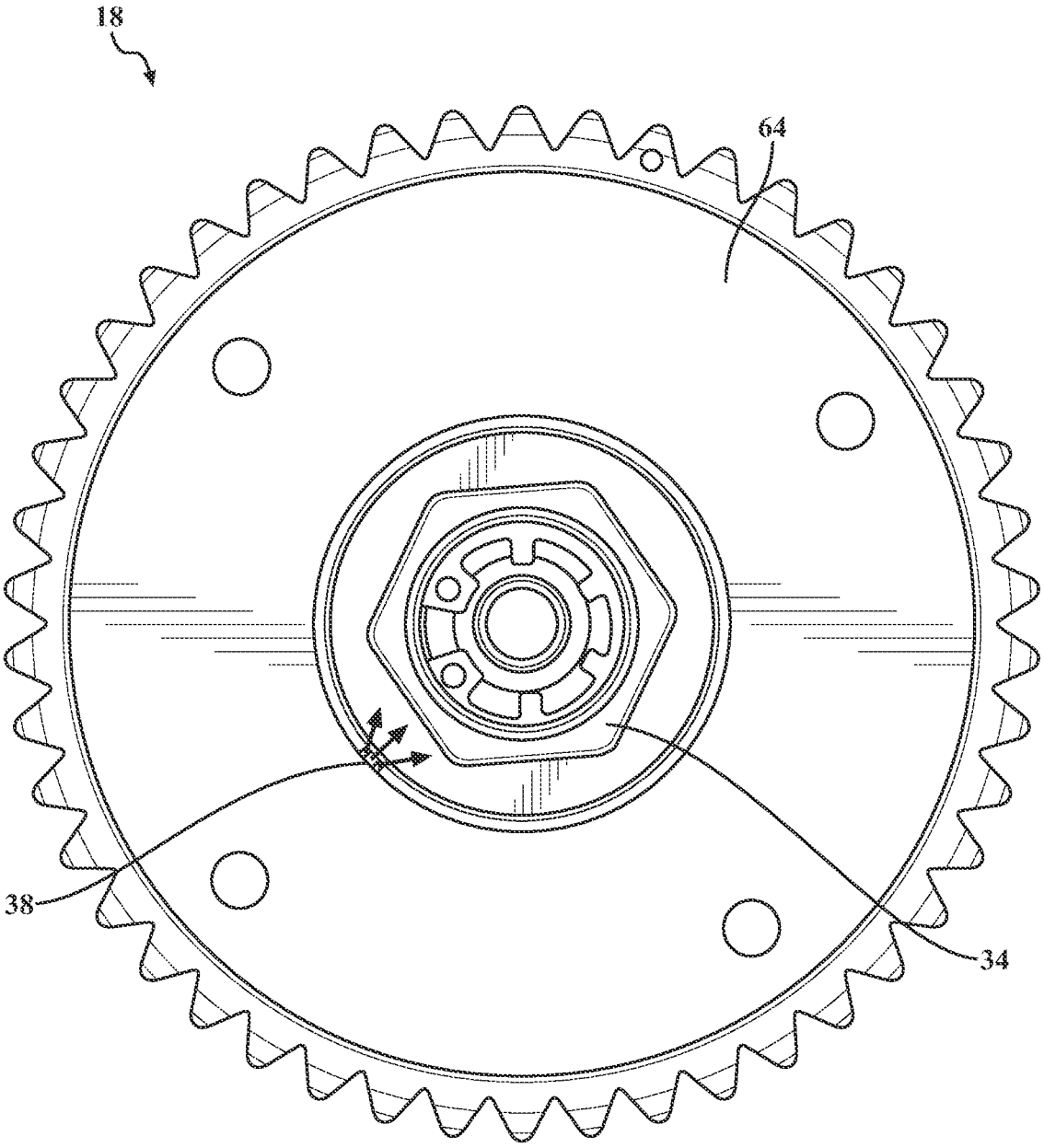
FIG. 25 is a frontal view of the variable cam timing phaser of FIGS. 22-24, with the vent path discharging hydraulic fluid.
Figure 26:
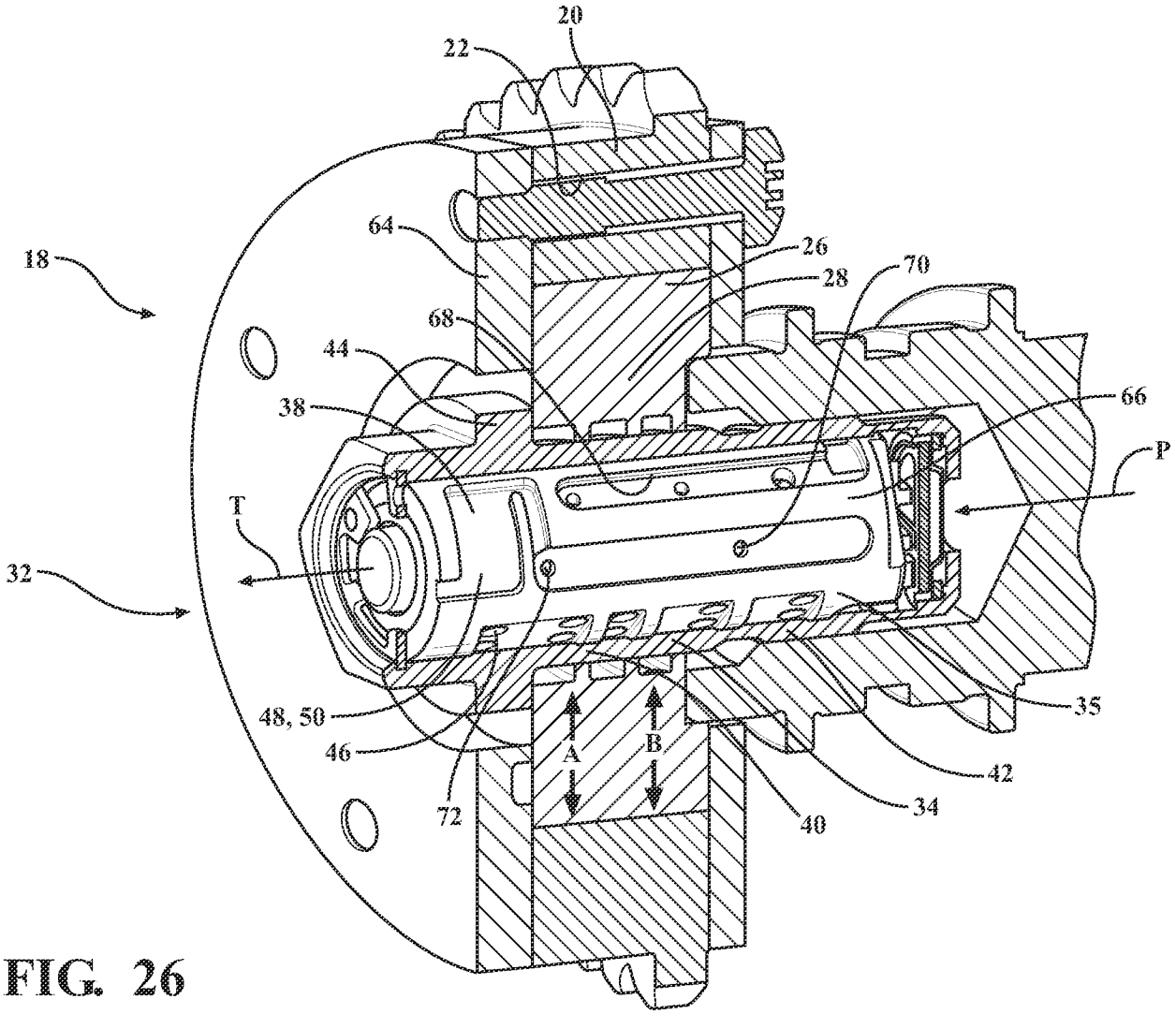
FIG. 26 is cross-sectional view of another embodiment of the variable cam timing phaser, with the control sleeve defining the vent path, and with the vent path having a first vent portion, a second vent portion, and with the second vent portion further defined as a vent chamber.
Figure 27:
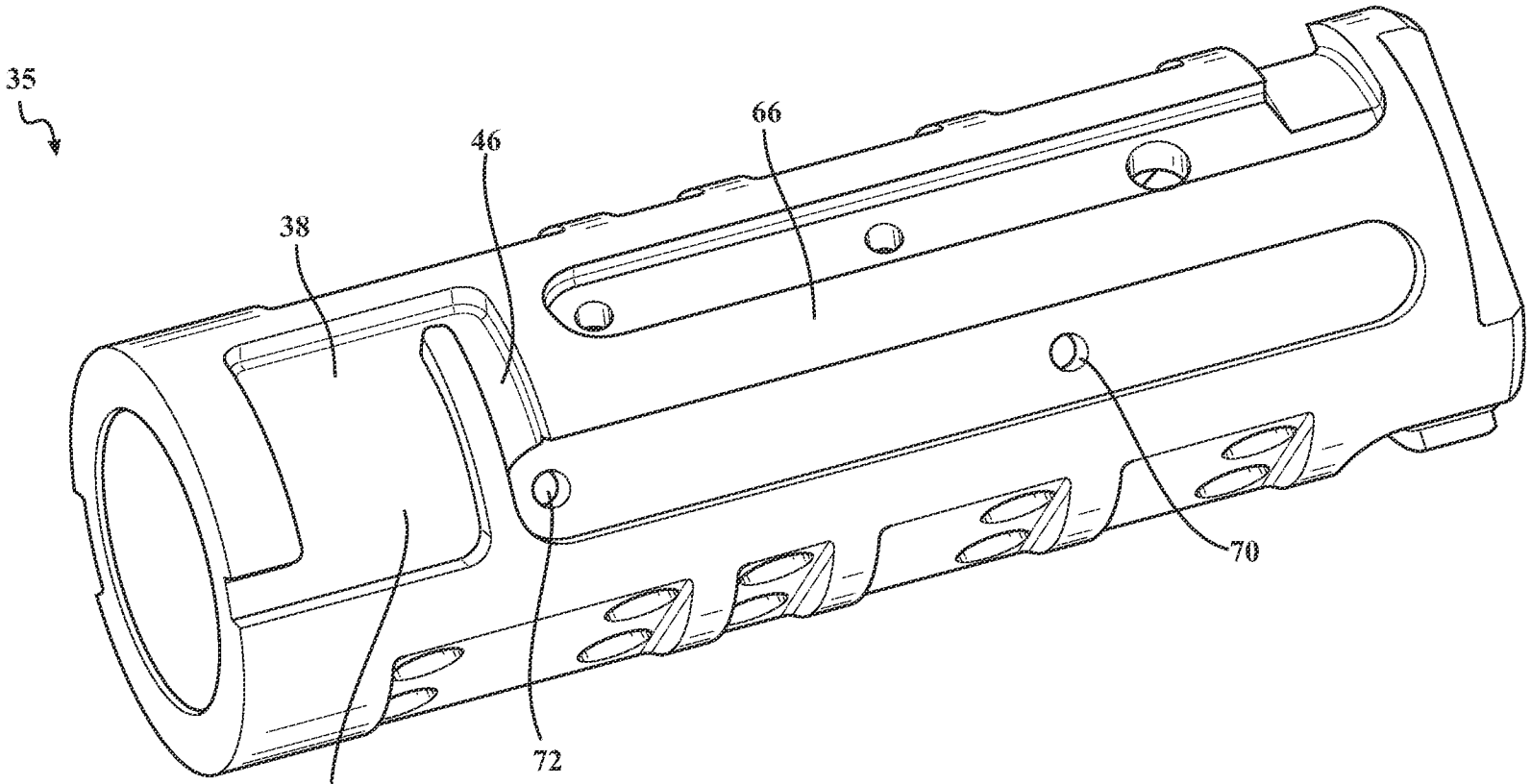
FIG. 27 is a perspective view of the control sleeve of FIG. 26.
Figure 31:
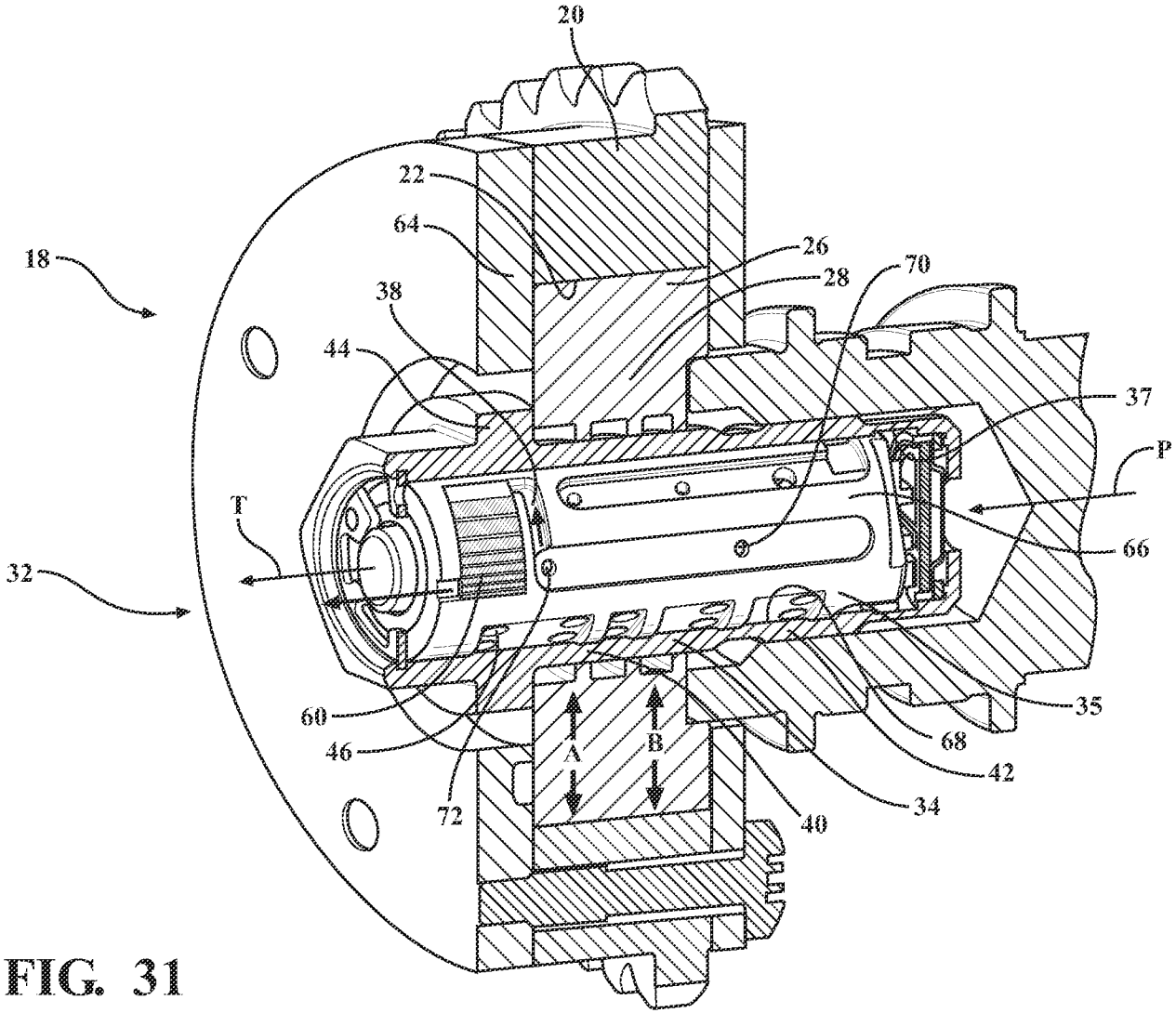
FIG. 31 is a cross-sectional view of another embodiment of the variable cam timing phaser, with the control sleeve defining the vent path, and with the control valve assembly including a restricting member disposed in the vent path.
Figure 32:
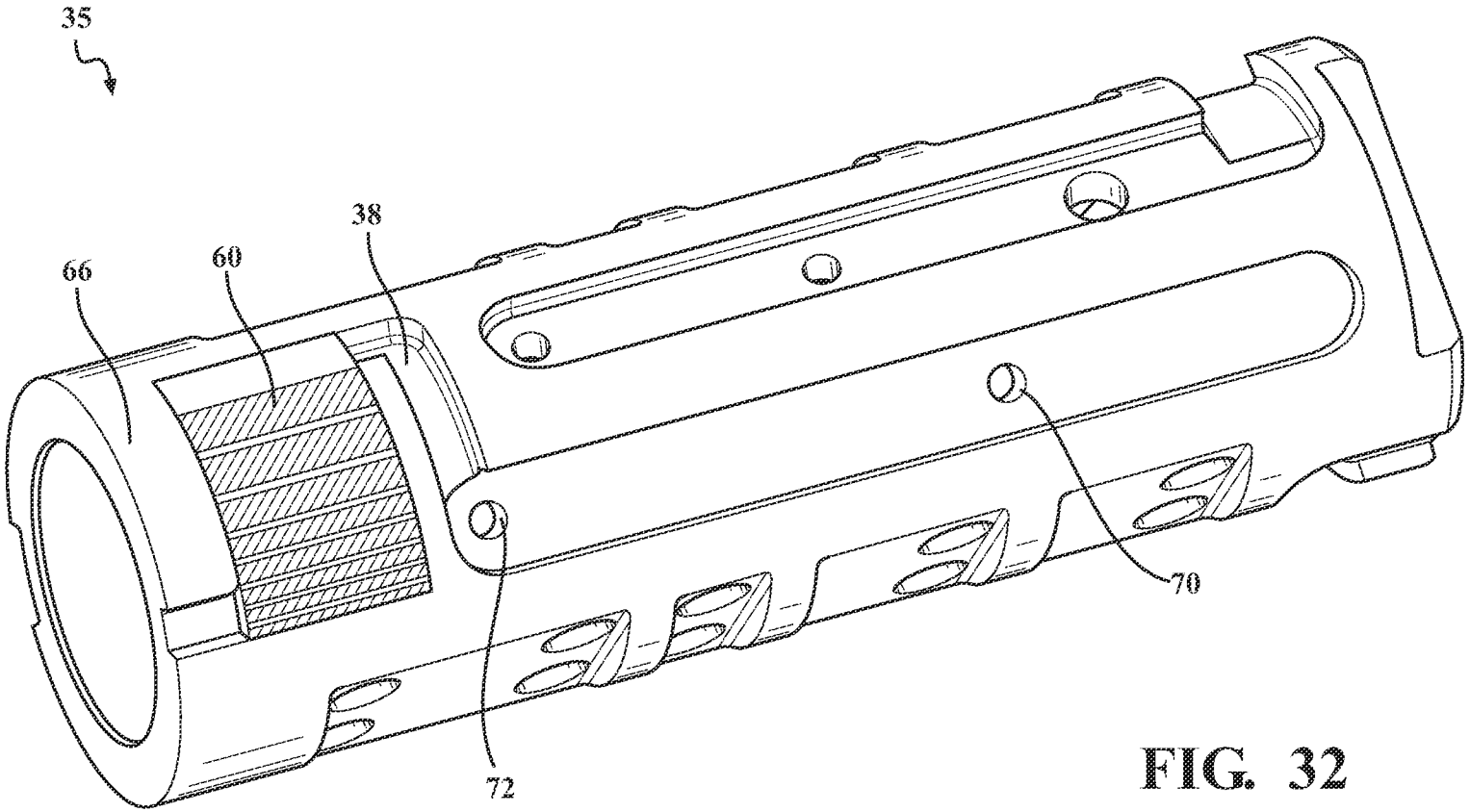
FIG. 32 is a perspective view of the control sleeve and restricting member of FIG. 31.

The restricting member 60 may be fixed to the rotor 26, to the valve housing 34, and/or to the control sleeve 35 such that the restricting member is 60 stationary with respect to the rotor 26, the valve housing 34, and/or the control sleeve 35 during operation of the variable cam timing phaser 18. It is to be appreciated in embodiments where the valve housing 34 and the rotor 26 both define the vent path 38, the vent path 38 defined by the valve housing 34 may include the restricting member 60, as shown in FIGS. 6 and 21, and/or the vent path 38 defined by the rotor 26 may include the restricting member 60, as shown in FIG. 24. Additionally, in the embodiments where the control sleeve 35 and the valve housing 34 both define the vent path 38, the vent path 38 defined by the control sleeve 35 may include the restricting member 60, as shown in FIGS. 31 and 32, the vent path 38 defined by the valve housing 34 may include the restricting member 60, or the vent path 38 defined by the control sleeve 35 and the valve housing 34 both may include the restricting member 60.

What is claimed is:

1. A variable cam timing phaser of a variable cam timing system, with the variable cam timing system including a camshaft, said variable cam timing phaser comprising:

a housing having a housing wall disposed about an axis and defining a housing interior;

a rotor at least partially disposed within said housing interior and moveable with respect to said housing, with said rotor having a hub and a plurality of vanes extending from said hub away from said axis toward said housing wall, and with said rotor and said housing defining an advance chamber and a retard chamber; and a control valve assembly comprising, a valve housing extending along an axis of said valve housing and defining a valve housing interior, with said valve housing also defining a supply port for supplying hydraulic fluid to said valve housing interior, a first working port, a second working port, and an exhaust port, with said first working port being fluidly connectable with one of said advance chamber and said retard chamber, and with said second working port being fluidly connectable with the other of said advance chamber and said retard chamber, and a piston disposed in said valve housing interior and moveable along said axis of said valve housing for controlling flow of the hydraulic fluid through said valve housing interior;

wherein said exhaust port is fluidly connectable with a sump through a vent path that is defined by at least one of said valve housing and said rotor;

wherein during a torque reversal of the camshaft said vent path is fluidly connectable with one of said advance and retard chambers and is configured to prevent air from being sucked into the variable cam timing phaser through said vent path;

wherein the variable cam timing phaser is free of a check valve that is moveable between an open position for allowing the flow of hydraulic fluid and a closed position for restricting the flow of hydraulic fluid in said vent path;

wherein said vent path has a first vent portion having a first flow area and a second vent portion having a second flow area, wherein said second flow area of said second vent portion is greater than said first flow area of said first vent portion for preventing air from being sucked into the variable cam timing phaser through said vent path;

wherein said second vent portion is further defined as a reservoir defining a reservoir volume; and wherein said reservoir volume is configured to be equivalent to or greater than a volume of hydraulic fluid consumed in the variable cam timing phaser during the torque reversal of the camshaft in which said rotor moves relative to said housing.

2. The variable cam timing phaser as set forth in claim 1, wherein said vent path is defined exclusively by said valve housing.

3. The variable cam timing phaser as set forth in claim 1, wherein said valve housing has a body portion defining said valve housing interior, and an engagement portion configured to engage the camshaft.

4. The variable cam timing phaser as set forth in claim 3, wherein said vent path is defined by said body portion of said valve housing.

5. The variable cam timing phaser as set forth in claim 3, wherein said body portion of said valve housing has a flange extending away from said axis of said valve housing, and wherein said vent path is defined in said flange.

6. The variable cam timing phaser as set forth in claim 1, wherein said vent path is defined by said rotor.

7. The variable cam timing phaser as set forth in claim 6, wherein said vent path is defined by said rotor and said valve housing.

8. The variable cam timing phaser as set forth in claim 1, wherein said first vent portion has a radial portion extending radially with respect to said axis of said valve housing and fluidly connectable with said valve housing interior to said second vent portion, and a longitudinal portion extending from said reservoir away from said radial portion.

9. A variable cam timing system comprising said variable cam timing phaser as set forth in claim 1, wherein said variable cam timing system comprises said camshaft.

10. A control valve assembly of a variable cam timing phaser of a variable cam timing system, with the variable cam timing phaser having a housing and a rotor defining an advance chamber and a retard chamber, and with the variable cam timing system including a camshaft, said control valve assembly comprising:

a valve housing extending along an axis and defining a valve housing interior, with said valve housing also defining a supply port for supplying hydraulic fluid to said valve housing interior, a first working port, a second working port, and an exhaust port, with said first working port being fluidly connectable with one of the advance chamber and the retard chamber, and with said second working port being fluidly connectable with the other of the advance chamber and the retard chamber; and a piston disposed in said valve housing interior and moveable along said axis for controlling flow of the hydraulic fluid through said valve housing interior;

wherein said exhaust port is fluidly connectable with a sump through a vent path that is defined by said valve housing;

wherein during a torque reversal of the camshaft said vent path is fluidly connectable with one of the advance and retard chambers and is configured to prevent air from being sucked into the variable cam timing phaser through said vent path;

wherein the control valve assembly is free of a check valve that is moveable between an open position for allowing the flow of hydraulic fluid and a closed position for restricting the flow of hydraulic fluid in said vent path;

wherein said vent path has a first vent portion having a first flow area and a second vent portion having a second flow area, wherein said second flow area of said second vent portion is greater than said first flow area of said first vent portion for preventing air from being sucked into the variable cam timing phaser through said vent path;

wherein said second vent portion is further defined as a reservoir defining a reservoir volume; and wherein said reservoir volume is configured to be equivalent to or greater than a volume of hydraulic fluid consumed in the variable cam timing phaser during the torque reversal of the camshaft in which the rotor moves relative to the housing.

11. The variable cam timing phaser as set forth in claim 10, wherein said first vent portion has a radial portion extending radially with respect to said axis of said valve housing and fluidly connectable with said valve housing interior to said second vent portion, and a longitudinal portion extending from said reservoir away from said radial portion.

* * * * *